US009665034B2

(12) United States Patent
Tajima

(10) Patent No.: US 9,665,034 B2
(45) Date of Patent: May 30, 2017

(54) IMAGE FORMING APPARATUS

(71) Applicant: CANON KABUSHIKI KAISHA, Tokyo (JP)

(72) Inventor: Hirotoshi Tajima, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/216,450

(22) Filed: Jul. 21, 2016

(65) Prior Publication Data

US 2017/0031265 A1 Feb. 2, 2017

(30) Foreign Application Priority Data

Jul. 31, 2015 (JP) ..... 2015-151730

(51) Int. Cl.

*G03G 15/00* (2006.01)
*G03G 15/043* (2006.01)
*G03G 15/01* (2006.01)

(52) U.S. Cl.

CPC ..... *G03G 15/043* (2013.01); *G03G 15/0131* (2013.01); *G03G 15/5058* (2013.01)

(58) Field of Classification Search

CPC ..... G03G 15/0131; G03G 15/5058; G03G 15/1615; G03G 2215/0161; G03G 2215/0132; G03G 2215/00059

See application file for complete search history.

(56) References Cited

U.S. PATENT DOCUMENTS 7,907,872 B2 3/2011 Komatsu et al. ..... 399/167
8,326,166 B2 12/2012 Yanagi ..... 399/55
2009/0297222 A1 12/2009 Kawamura ..... 399/167
2010/0221029 A1* 9/2010 Minbu ..... G03G 15/0131 399/66
2012/0045256 A1 2/2012 Sasaoka et al. ..... 399/301
2014/0146120 A1* 5/2014 Miyadera ..... G03G 15/01 347/116

FOREIGN PATENT DOCUMENTS

JP 2006-085153 3/2006

OTHER PUBLICATIONS

Extended European Search Report dated Jan. 10, 2017, in counterpart European Application No. 16181846.3.

* cited by examiner

*Primary Examiner* — Walter L Lindsay, Jr.
*Assistant Examiner* — Jessica L Eley
(74) *Attorney, Agent, or Firm* — Fitzpatrick, Cella, Harper & Scinto

(57) ABSTRACT

An image forming apparatus including: a first and a second photosensitive members, an endless transfer belt, a transfer unit configured form a transfer nip with the endless transfer belt, a storage unit configured to store first and second delay data each indicating an amount of delay of a second exposure start timing of the second photosensitive member with respect to a first exposure start timing of the first photosensitive member, a control unit configured to control the second exposure start timing based on the first delay data until a first recording medium enters the transfer nip and control the second exposure start timing based on the second delay data after the first recording medium enters the transfer nip.

13 Claims, 18 Drawing Sheets

FIG. 12A

| | Tb0 | Tb1 | Tb2 | Tb3 |
|---|---|---|---|---|
| THIN SHEET, PLAIN SHEET (-105g/m$^2$) | 0 | 0 | 0 | 0 |
| THICK SHEET 1 (106-128g/m$^2$) | 0 | 0 | 0 | 0 |
| THICK SHEET 2 (129-150g/m$^2$) | 0 | $5.60\times10^{-6}$ | $8.45\times10^{-6}$ | $1.18\times10^{-5}$ |
| THICK SHEET 3 (151-180g/m$^2$) | 0 | $1.04\times10^{-5}$ | $1.61\times10^{-5}$ | $2.18\times10^{-5}$ |
| THICK SHEET 4 (181-209g/m$^2$) | 0 | $1.04\times10^{-5}$ | $1.61\times10^{-5}$ | $2.18\times10^{-5}$ |
| THICK SHEET 5 (210-256g/m$^2$) | 0 | $2.18\times10^{-5}$ | $4.46\times10^{-5}$ | $6.74\times10^{-5}$ |
| THICK SHEET 6 (257-300g/m$^2$) | 0 | $2.18\times10^{-5}$ | $4.46\times10^{-5}$ | $6.74\times10^{-5}$ |
| THICK SHEET 7 (301-325g/m$^2$) | 0 | $3.32\times10^{-5}$ | $6.74\times10^{-5}$ | $9.30\times10^{-5}$ |
| THICK SHEET 8 (326-350g/m$^2$) | 0 | $3.32\times10^{-5}$ | $6.74\times10^{-5}$ | $9.30\times10^{-5}$ |

FIG. 12B

| | Tb0 | Tb1 | Tb2 | Tb3 |
|---|---|---|---|---|
| SINGLE/BOTH SIDE COAT 1 (80-105g/m$^2$) | 0 | 0 | 0 | 0 |
| SINGLE/BOTH SIDE COAT 2 (106-128g/m$^2$) | 0 | 0 | 0 | 0 |
| SINGLE/BOTH SIDE COAT 3 (129-150g/m$^2$) | 0 | $1.04\times10^{-5}$ | $1.61\times10^{-5}$ | $2.18\times10^{-5}$ |
| SINGLE/BOTH SIDE COAT 4 (151-180g/m$^2$) | 0 | $1.04\times10^{-5}$ | $1.61\times10^{-5}$ | $2.18\times10^{-5}$ |
| SINGLE/BOTH SIDE COAT 5 (181-209g/m$^2$) | 0 | $2.18\times10^{-5}$ | $4.46\times10^{-5}$ | $6.74\times10^{-5}$ |
| SINGLE/BOTH SIDE COAT 6 (210-256g/m$^2$) | 0 | $2.18\times10^{-5}$ | $4.46\times10^{-5}$ | $6.74\times10^{-5}$ |
| SINGLE/BOTH SIDE COAT 7 (257-300g/m$^2$) | 0 | $3.32\times10^{-5}$ | $6.74\times10^{-5}$ | $9.30\times10^{-5}$ |
| SINGLE/BOTH SIDE COAT 8 (301-325g/m$^2$) | 0 | $3.32\times10^{-5}$ | $6.74\times10^{-5}$ | $9.30\times10^{-5}$ |
| SINGLE/BOTH SIDE COAT 9 (326-350g/m$^2$) | 0 | $4.46\times10^{-5}$ | $9.02\times10^{-5}$ | $1.72\times10^{-4}$ |

FIG. 12C

| | Tb0 | Tb1 | Tb2 | Tb3 |
|---|---|---|---|---|
| MATT COATED SHEET 1 (80-105g/m$^2$) | 0 | 0 | 0 | 0 |
| MATT COATED SHEET 2 (106-128g/m$^2$) | 0 | 0 | 0 | 0 |
| MATT COATED SHEET 3 (129-150g/m$^2$) | 0 | $9.02\times10^{-6}$ | $1.27\times10^{-5}$ | $1.72\times10^{-5}$ |
| MATT COATED SHEET 4 (151-180g/m$^2$) | 0 | $9.02\times10^{-6}$ | $1.27\times10^{-5}$ | $1.72\times10^{-5}$ |
| MATT COATED SHEET 5 (181-209g/m$^2$) | 0 | $1.72\times10^{-5}$ | $3.55\times10^{-5}$ | $5.37\times10^{-5}$ |
| MATT COATED SHEET 6 (210-256g/m$^2$) | 0 | $1.72\times10^{-5}$ | $3.55\times10^{-5}$ | $5.37\times10^{-5}$ |
| MATT COATED SHEET 7 (257-300g/m$^2$) | 0 | $2.64\times10^{-5}$ | $5.37\times10^{-5}$ | $8.11\times10^{-5}$ |
| MATT COATED SHEET 8 (301-325g/m$^2$) | 0 | $2.64\times10^{-5}$ | $5.37\times10^{-5}$ | $8.11\times10^{-5}$ |
| MATT COATED SHEET 9 (326-350g/m$^2$) | 0 | $3.55\times10^{-5}$ | $7.20\times10^{-5}$ | $1.36\times10^{-4}$ |

IMAGE FORMING APPARATUS

BACKGROUND OF THE INVENTION

Field of the Invention

The present invention relates to an image forming apparatus including an intermediate transfer member.

Description of the Related Art

Exemplary image forming apparatus include an electrophotographic copying machine (e.g., a digital copying machine), electrophotographic printers (e.g., a color laser beam printer and a color LED printer), a multifunction peripheral (MFP), a facsimile apparatus, and a printing apparatus. Such an image forming apparatus is configured to form an image on a recording medium using an electrophotographic image forming process. An example of an image forming apparatus configured to form a color image is an apparatus including a plurality of image forming portions, an intermediate transfer belt, and a transfer device. The plurality of image forming portions are configured to form toner images on a plurality of photosensitive members. The toner images of a plurality of colors formed on the respective photosensitive members by the plurality of image forming portions are transferred onto the intermediate transfer belt. The transfer device is configured to transfer the toner images on the respective photosensitive members onto a recording medium through the intermediate transfer belt. The transfer device includes a transfer roller and a counter roller as a mechanism configured to transfer the toner images onto the recording medium from the intermediate transfer belt. The intermediate transfer belt is stretched around a plurality of rollers including the counter roller. The transfer roller and the counter roller form a nip portion serving as a secondary transfer portion. The intermediate transfer belt passes through the nip portion. A recording medium passes through the nip portion to allow the toner images on the intermediate transfer belt to be transferred onto the recording medium.

Image forming portions on an upstream side and a downstream side in a movement direction of a surface of the intermediate transfer belt are referred to as a first image forming portion and a second image forming portion, respectively. Each of the image forming portions includes a photosensitive member and is configured to form a toner image on the photosensitive member. The toner image formed on the photosensitive member in each image forming portion is transferred onto the intermediate transfer belt in a primary transfer portion formed between the photosensitive member and the intermediate transfer belt. With respect to a timing of image formation on a recording medium at the first image forming portion, a start timing of image formation on the same recording medium at the second image forming portion is delayed based on a surface speed of the intermediate transfer belt, a distance between the photosensitive members in adjacent primary transfer portions, and a detected color misregistration amount.

However, the surface speed of the intermediate transfer belt may fluctuate when a recording medium enters the secondary transfer portion. As for an image to be transferred onto a recording medium following a recording medium entering the secondary transfer portion, toner images of a plurality of colors cannot be correctly superimposed on each other on the intermediate transfer belt due to fluctuations of the surface speed of the intermediate transfer belt, thus causing color misregistration.

SUMMARY OF THE INVENTION

Accordingly, the present invention reduces color misregistration in an image formed by an image forming apparatus including an intermediate transfer belt.

According to one embodiment of the present invention, there is provided an image forming apparatus comprising:

an image forming unit comprising a first photosensitive member and a second photosensitive member, the image forming unit being configured to expose the first photosensitive member and the second photosensitive member to light based on image data, and to develop electrostatic latent images formed on the first photosensitive member and the second photosensitive member by exposure to the light with toners of different colors;

an endless transfer belt stretched around a plurality of rollers and driven to rotate, wherein a toner image on the first photosensitive member and a toner image on the second photosensitive member are transferred onto the endless transfer belt;

a transfer unit configured to transfer the toner images on the endless transfer belt onto a recording medium entering a transfer nip formed between the transfer unit and the endless transfer belt, wherein in a direction of rotation of the endless transfer belt, a second transfer portion at which the toner image on the second photosensitive member is transferred onto the endless transfer belt is arranged between a first transfer portion at which the toner image on the first photosensitive member is transferred onto the endless transfer belt and the transfer unit;

a holding unit configured to hold recording media;

a conveyance unit configured to convey the recording medium held by the holding unit to the transfer nip;

a storage unit configured to store delay data indicating an amount of delay of an exposure start timing of the second photosensitive member with respect to an exposure start timing of the first photosensitive member for forming electrostatic latent images corresponding to one recording medium, wherein the delay data includes: first delay data indicating the amount of delay of the exposure start timing of the second photosensitive member; and second delay data indicating the amount of delay of the exposure start timing of the second photosensitive member, and the amount of delay based on the second delay data is larger than the amount of delay based on the first delay data; and a control unit configured to delay the exposure start timing of the second photosensitive member with respect to the exposure start timing of the first photosensitive member on image formation corresponding to one recording medium, wherein in a state in which an image forming job for forming the images on a plurality of the recording media is inputted, the control unit controls the exposure start timing of the second photosensitive member based on the first delay data until a first recording medium included in the plurality of the recording media enters the transfer nip and controls the exposure start timing of the second photosensitive member based on the second delay data after the first recording medium enters the transfer nip.

Further features of the present invention will become apparent from the following description of exemplary embodiments with reference to the attached drawings.

BRIEF DESCRIPTION OF THE DRAWINGS

FIG. 12A, FIG. 12B, and FIG. 12C are each a lookup table including media information and predetermined time periods.

DESCRIPTION OF THE EMBODIMENTS

In the following, an embodiment of the present invention is illustratively described in detail with reference to the drawings. Sizes, materials, and shapes of components described in the following embodiment, and their relative positions, need to be subject to appropriate change in accordance with a configuration and various conditions of an apparatus to which the present invention is applied. Accordingly, as long as there is no specific description, it is not intended to limit the scope of the present invention only to the embodiment.

(Image Forming Apparatus)

Figure 1:
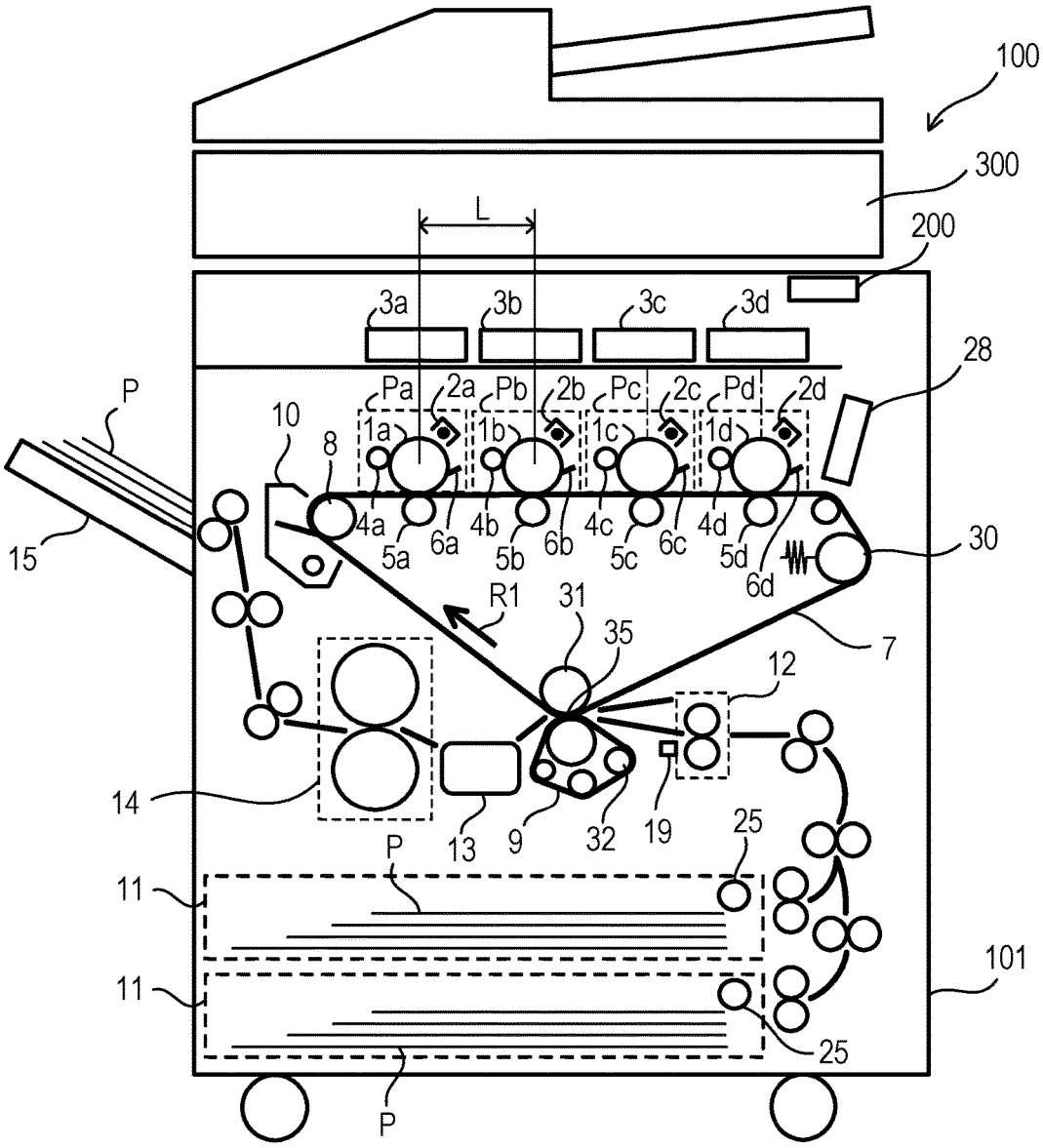
FIG. 1 is a cross-sectional view of an image forming apparatus.

An image forming apparatus according to an embodiment of the present invention is described. A four-drum, full-color electrographic image forming apparatus (hereinafter referred to as "image forming apparatus") 100 including an intermediate transfer belt 7 is described herein as an example of the image forming apparatus. FIG. 1 is a cross-sectional view of the image forming apparatus 100.

The image forming apparatus 100 adopts a tandem system in which a plurality of light scanning devices 3 and a plurality of photosensitive drums 1*a* to 1*d* are arranged in line along the intermediate transfer belt 7 to perform concurrent processing of image forming processes in respective colors. Then, the image forming apparatus 100 adopts an intermediate transfer system in which a recording medium (hereinafter referred to as "sheet") P is passed through a secondary transfer nip 35 formed between a secondary transfer belt 9 applied with a transfer voltage and the intermediate transfer belt 7, to thereby transfer toner images onto the sheet P. The image forming apparatus 100 can perform continuous image formation (continuous printing) in which a plurality of sheets P are continuously conveyed to continuously form images on the plurality of sheets P by one job.

The image forming apparatus 100 includes a housing 101 and the housing 101 includes four image forming portions Pa, Pb, Pc, and Pd. The image forming portions Pa, Pb, Pc, and Pd are configured to form images of yellow (Y), magenta (M), cyan (C), and black (K), respectively. Here, the color order is not limited to this but the colors may be in order of K, M, Y, and C or order of M, Y, C, and K. Suffixes a, b, c, and d of the reference symbols represent yellow, magenta, cyan, and black, respectively. The four image forming portions Pa, Pb, Pc, and Pd have the same structure except for the colors of developers (toners), and hence, in the following description, the suffixes a, b, c, and d are sometimes omitted from the reference symbols unless otherwise necessary.

The rotatable photosensitive drums (photosensitive members) 1*a*, 1*b*, 1*c*, and 1*d* are arranged in the image forming portions Pa to Pd, respectively. Charging devices 2*a*, 2*b*, 2*c*, and 2*d*, the light scanning devices 3*a*, 3*b*, 3*c*, and 3*d*, developing devices 4*a*, 4*b*, 4*c*, and 4*d*, primary transfer rollers 5*a*, 5*b*, 5*c*, and 5*d*, and cleaning devices 6*a*, 6*b*, 6*c*, and 6*d* are arranged on peripheries of the photosensitive drums 1 along their directions of rotation, respectively. According to the embodiment, the plurality of light scanning devices 3 are arranged in the plurality of image forming portions P, respectively. Each light scanning device 3 emits laser light (hereinafter referred to as "light beam") to the corresponding photosensitive drum 1 based on image data. However, the light scanning devices 3 may be replaced by a light scanning device configured to emit a plurality of light beams to the plurality of photosensitive drums 1. Alternatively, an LED head having a plurality of light emitting elements which are arranged in line in a longitudinal direction of the photosensitive drum 1 and are configured to emit light based on image data for exposure of the photosensitive drum 1 may be used instead of the light scanning device 3 as an exposure unit configured to expose the photosensitive drum 1 to light.

The charging devices 2 are configured to uniformly charge surfaces of the photosensitive drums 1, respectively. The light scanning devices 3 are configured to irradiate the uniformly charged surfaces of the photosensitive drums 1 with light beams modulated based on image data to form electrostatic latent images on the photosensitive drums 1, respectively. The developing devices 4 are configured to develop the electrostatic latent images using the toners (developers) of the respective colors to form toner images of the respective colors. The primary transfer rollers 5 are configured to sequentially perform primary transfer of the toner images of the respective colors on the photosensitive drums 1 onto the intermediate transfer belt 7 so that the toner images are superimposed on each other. Toner remaining on the photosensitive drums 1 after the primary transfer is removed by the cleaning devices 6 and the photosensitive drums 1 are ready for formation of a succeeding image.

According to the embodiment, the plurality of image forming portions Pa to Pd are horizontally arranged in line. The endless intermediate transfer belt (intermediate transfer member) 7 having an elastic layer is arranged below the photosensitive drums 1*a* to 1*d* horizontally arranged in line. The elastic layer may be formed of elastic rubber. The intermediate transfer belt 7 is stretched around a tension roller 30, a secondary transfer inner counter roller 31, and a drive roller 8. The toner images of the plurality of colors formed on the plurality of photosensitive drums 1*a*, 1*b*, 1*c*, and 1*d* are sequentially primarily transferred onto the intermediate transfer belt 7 by the primary transfer rollers 5*a*, 5*b*, 5*c*, and 5*d* to be superimposed on each other.

The polyimide-containing endless secondary transfer belt (secondary transfer member) 9 is configured to be capable of coming into or out of contact with the intermediate transfer belt 7. The secondary transfer belt 9 is stretched around a plurality of rollers including a drive roller 32. According to the embodiment, the secondary transfer belt 9 is used as the secondary transfer member. However, a secondary transfer roller formed of a mixture of epichlorohydrin and NBR may be used as the secondary transfer member. The secondary transfer belt 9 and the intermediate transfer belt 7 form the secondary transfer nip (secondary transfer portion) 35 therebetween.

Sheets P are contained in sheet feed cassettes 11. Each of sheet feed rollers 25 is configured to feed sheets P one by one from the corresponding sheet feed cassette 11 to a registration adjusting portion 12. The registration adjusting portion (conveyance portion) 12 is configured to correct tilting of the sheets P and convey the orientation-corrected sheets P to the secondary transfer nip 35 at a timing synchronized with the toner images on the intermediate transfer belt 7. A sheet sensor 19 being arranged on a downstream side of the registration adjusting portion 12 and serving as a detection unit is configured to detect a sheet P to be conveyed from the registration adjusting portion 12 toward the secondary transfer nip 35. The sheet P reaches the secondary transfer nip 35 after a predetermined time period has passed from detection of the sheet P with the sheet sensor 19. The secondary transfer belt 9 is configured to transfer the toner images on the intermediate transfer belt 7 onto the sheet P passing through the secondary transfer nip 35. An intermediate transfer belt cleaning device 10 is arranged in proximity to the intermediate transfer belt 7 at a position facing the drive roller 8. The intermediate transfer belt cleaning device 10 is configured to collect toner remaining on a surface of the intermediate transfer belt 7 without being transferred onto the sheet P.

The sheet P having the toner images transferred thereonto is conveyed by a conveyor belt 13. The conveyor belt 13 is driven by a drive motor (not shown). The sheet P is conveyed to a fixing device 14 arranged downstream of the conveyor belt 13, and is applied with heat and pressure in the fixing device 14 to form a full-color image on the sheet P. The sheet P having the image formed thereon is delivered onto a delivery tray 15 arranged outside the housing 101. As described above, the toner images of the plurality of colors formed on the plurality of photosensitive drums 1 are superimposed on each other on the rotatable intermediate transfer belt 7 to form the full-color image on the sheet P.

(Light Scanning Device)

Figure 2:
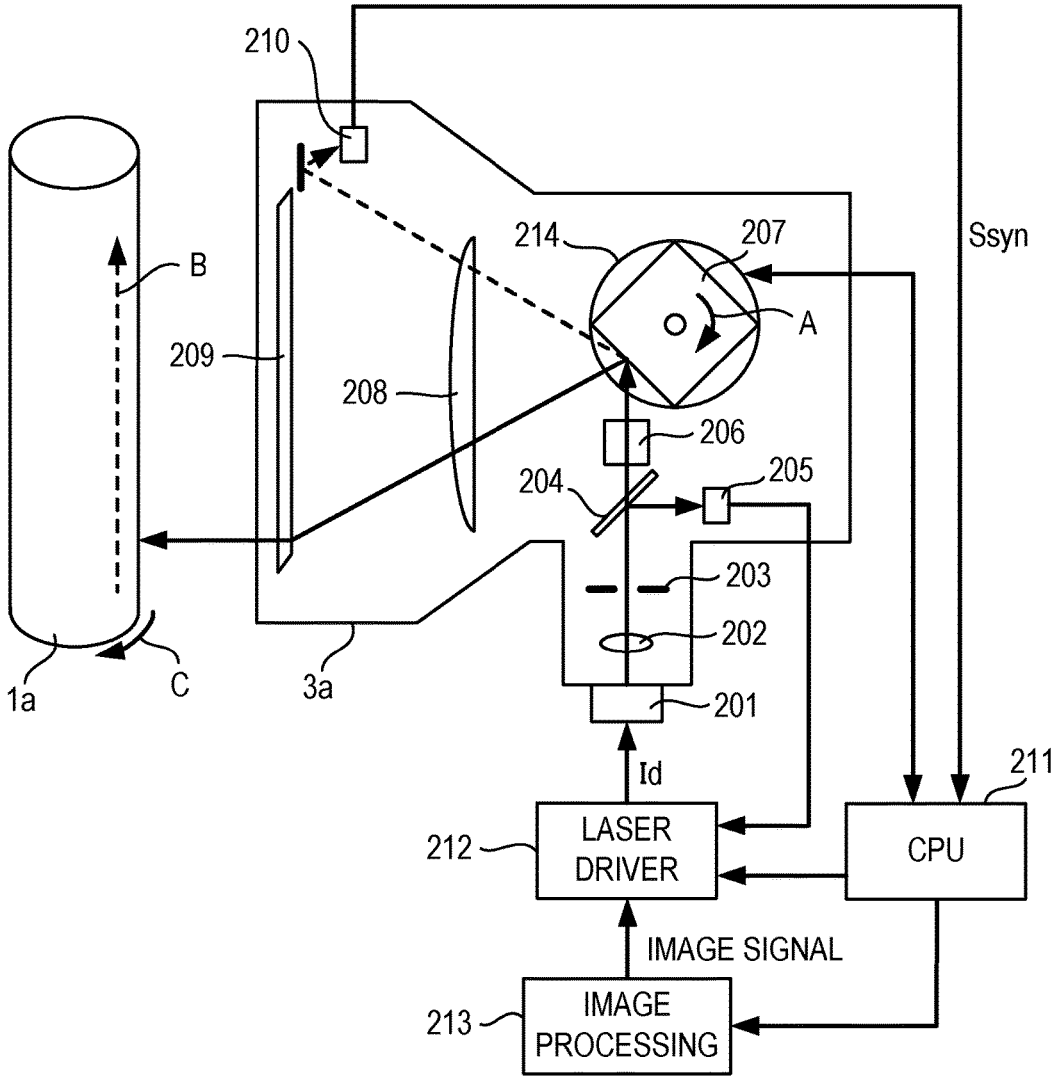
FIG. 2 is a schematic view for illustrating a light scanning device and a photosensitive drum.

FIG. 2 is a schematic view for illustrating the light scanning device 3*a* and the photosensitive drum 1*a*. The light scanning devices 3*a*, 3*b*, 3*c*, and 3*d* are arranged in the image forming portions Pa, Pb, Pc, and Pd, respectively. The light scanning devices 3*a*, 3*b*, 3*c*, and 3*d* have the same structure. Therefore, the light scanning device 3*a* is described below and a description of the light scanning devices 3*b*, 3*c*, and 3*d* is omitted. The light scanning device 3*a* includes a semiconductor laser 201, a collimator lens 202, a diaphragm 203, a beam splitter 204, a photodiode 205, and a cylindrical lens 206. The light scanning device 3*a* further includes a rotary polygon mirror 207, an fθ lens 208, a reflecting mirror 209, and a beam detector 210 (hereinafter abbreviated as "BD 210").

The semiconductor laser 201 (laser light source) is configured to emit laser light (light beams) based on image data. The light scanning device 3*a* according to the embodiment includes a vertical cavity surface emitting laser (VCSEL) as the semiconductor laser 201. However, an edge emitting semiconductor laser may be used in the embodiment. The semiconductor laser 201 is driven by a laser driver 212 (laser control unit). The laser driver 212 is connected to a CPU 211 and an image processing portion 213. When an image forming job is input to the image forming apparatus 100 from a reading device 300 (FIG. 1) or an external information terminal, e.g., in a PC (not shown), the CPU 211 outputs a light emission enable signal to the laser driver 212.

The image processing portion 213 is configured to process image data contained in the image forming job to be input to the image forming apparatus 100 from the reading device 300 or the external information terminal, e.g., a PC (not shown), and output the processed image data to the laser driver 212 as an image signal. The laser driver 212 supplies a drive current Id to the semiconductor laser 201 based on the image signal (drive signal) output from the image processing portion 213. In response to supply of the drive current Id from the laser driver 212, the semiconductor laser 201 emits a light beam.

The light beam emitted from the semiconductor laser 201 passes through the collimator lens 202 to become a substantially collimated light beam. A spot formed of the light beam having passed through the collimator lens 202 is shaped by the diaphragm 203. The light beam having passed through the diaphragm 203 enters the beam splitter 204 serving as a beam separation unit. The light beam having entered the beam splitter 204 is separated into a first light beam reflected by the beam splitter 204 (reflected laser light) and a second light beam transmitted through the beam splitter 204 (transmitted laser light).

The first light beam enters the photodiode 205 serving as a light receiving unit. In contrast, the second light beam passes through the cylindrical lens 206 to enter a reflecting surface of the rotary polygon mirror 207 (polygon mirror) serving as a deflection unit. The rotary polygon mirror 207 is driven by a motor 214 to rotate in a direction of the arrow A. The second light beam having passed through the cylindrical lens 206 is deflected by the reflecting surface of the rotary polygon mirror 207 driven to rotate, thereby enabling scanning on the photosensitive drum 1*a* illustrated in FIG. 2 in a direction of the arrow B. The second light beam deflected by the rotary polygon mirror 207 passes through the fθ lens 208 and is reflected by the reflecting mirror 209 to be guided onto the photosensitive drum 1*a*.

The second light beam deflected by the rotary polygon mirror 207 enters the BD 210. In response to reception of the second light beam, the BD 210 generates a BD signal (hereinafter referred to as "synchronizing signal Ssyn"). The synchronizing signal Ssyn generated by the BD 210 is transmitted to the CPU 211 illustrated in FIG. 2. The CPU 211 manages an execution timing of each of various control processes based on the synchronizing signal Ssyn. The synchronizing signal Ssyn is a synchronizing signal in a main scanning direction, for fixing a writing start position in the main scanning direction of an image in each scanning operation. Further, the CPU 211 uses the synchronizing signal Ssyn to perform rotation phase control and rotational speed control of the motor 214 for the rotary polygon mirror 207. The rotation phase control is described later.

(Control System)

Figure 3:
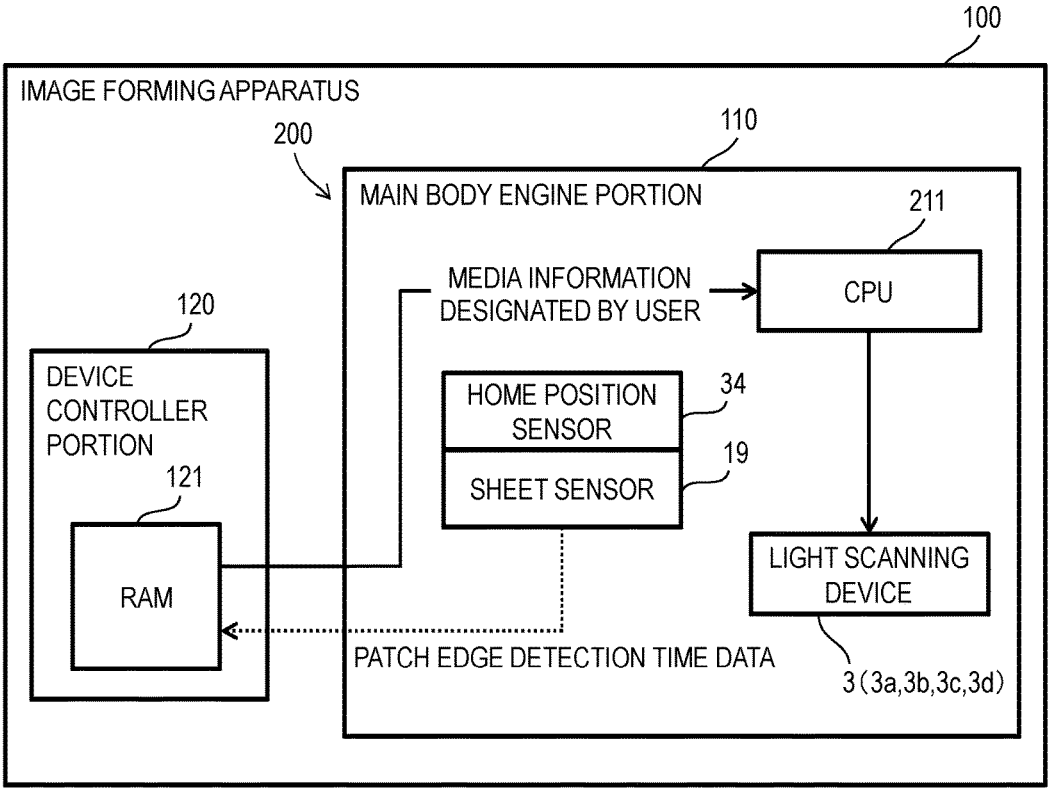
FIG. 3 is a diagram for illustrating a control system.

The housing 101 of the image forming apparatus 100 includes a control system 200. FIG. 3 is a diagram for illustrating the control system 200. The control system 200 includes a main body engine portion 110 and a device controller portion 120. The main body engine portion 110 includes the image forming portions Pa, Pb, Pc, and Pd making up an engine portion and the CPU 211 configured to perform control on image forming processes (for example, sheet feed process) in the image forming portions Pa, Pb, Pc, and Pd. The device controller portion 120 includes an RAM (storage device) 121. The RAM 121 is configured to store data detected by the sheet sensor 19 and a home position sensor 34 to be described later and media information designated by a user.

(Intermediate Transfer Belt and Secondary Transfer Belt)

Figure 4:
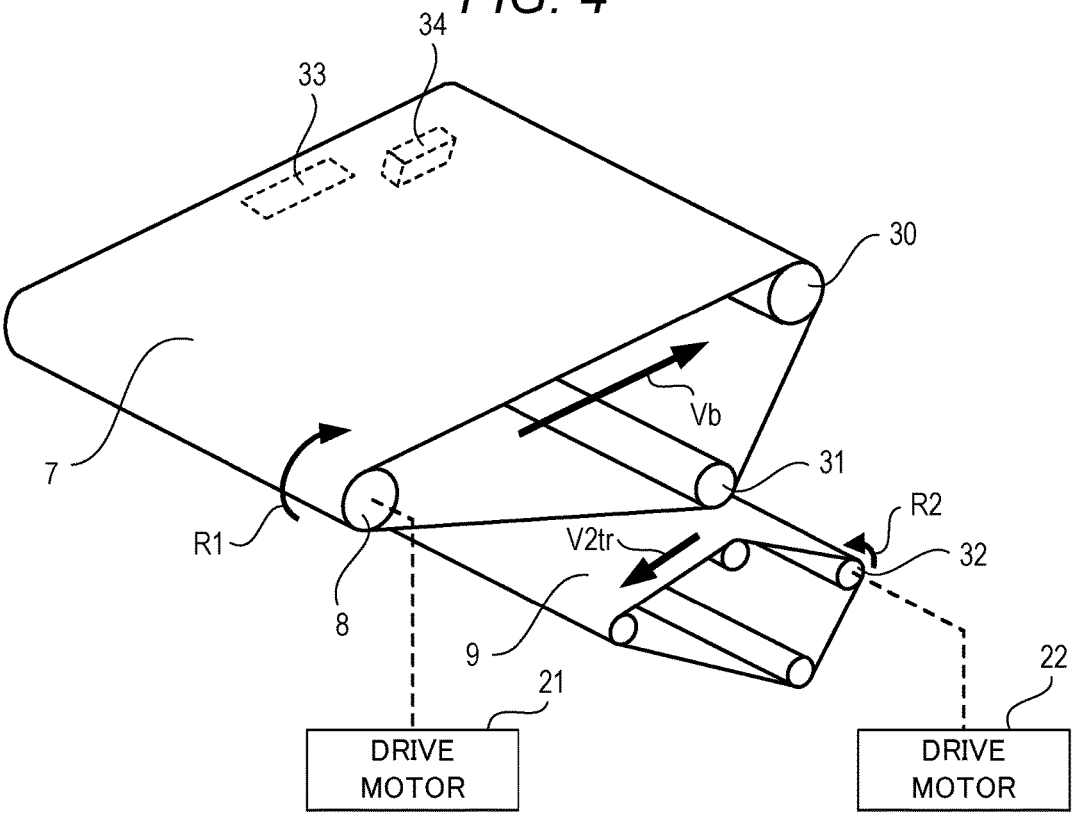
FIG. 4 is a perspective view of an intermediate transfer belt and a secondary transfer belt.

FIG. 4 is a perspective view of the intermediate transfer belt 7 and the secondary transfer belt 9. A home position seal 33 is applied to an inner peripheral surface of the intermediate transfer belt 7 on its back side. The home position sensor (hereinafter referred to simply as "sensor") 34 is arranged inside the intermediate transfer belt 7 stretched around the three rollers at a position enabling the sensor 34 to detect the home position seal 33. The sensor 34 is a reflection type optical sensor configured to irradiate an inside surface of the intermediate transfer belt 7 stretched around the three rollers (rear surface opposite to a surface onto which toner images are transferred) with light, and to receive the light reflected by the inside surface of the intermediate transfer belt 7 and the home position seal 33 applied to the inside surface. The sensor 34 functions as a round detection unit configured to detect the home position seal 33 to detect a time period (predetermined time period Tm) required for the intermediate transfer belt 7 to make one round.

The sheet P is nipped in and conveyed through the secondary transfer nip 35 formed between the intermediate transfer belt 7 and the secondary transfer belt 9. When the sheet P enters the secondary transfer nip 35, a rotational speed of the secondary transfer belt 9 may fluctuate. In a case where the intermediate transfer belt 7 and the secondary transfer belt 9 are rotated by the same drive source, the fluctuations in rotational speed occurred in the secondary transfer belt 9 may affect a rotational speed of the intermediate transfer belt 7 to cause fluctuations in rotational speed of the intermediate transfer belt 7. Occurrence of the fluctuations in rotational speed of the intermediate transfer belt 7 causes color misregistration on an image in a direction of rotation of the intermediate transfer belt 7 (sub-scanning direction).

Accordingly, a drive source of the intermediate transfer belt 7 and a drive source of the secondary transfer belt 9 are arranged independently of each other to set the rotational speed of the intermediate transfer belt 7 and the rotational speed of the secondary transfer belt 9, separately. As illustrated in FIG. 4, a drive motor (drive source) 21 rotates the drive roller 8 to cause the intermediate transfer belt 7 to rotate in a direction indicated by the arrow R1. A drive motor (drive source) 22, which is separate from the drive motor 21 for the intermediate transfer belt 7, rotates the drive roller 32 to cause the secondary transfer belt 9 to rotate in a direction indicated by the arrow R2.

According to the embodiment, a set value of a surface speed (first speed) Vb of the intermediate transfer belt 7 is different from a set value of a surface speed (second speed) V2*tr* of the secondary transfer belt 9. From the viewpoint of transferring properties, a predetermined speed difference is provided between the surface speed Vb of the intermediate transfer belt 7 and the surface speed V2*tr* of the secondary transfer belt 9 in the secondary transfer nip 35. According to the embodiment, the surface speed Vb of the intermediate transfer belt 7 is higher than the surface speed V2*tr* of the secondary transfer belt 9 (Vb>V2*tr*).

(Color Registration Correction)

Figure 5:
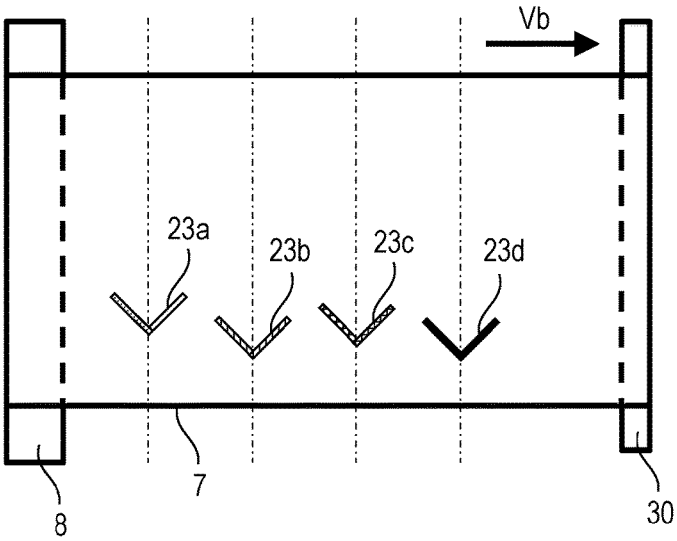
FIG. 5 is a view for illustrating registration patches formed on the intermediate transfer belt.

Color registration correction is a correction for positioning toner images of the plurality of colors so that the toner images of the respective colors are correctly superimposed on each other on the intermediate transfer belt 7. The color registration correction is performed under a state in which there is a difference in surface speed between the intermediate transfer belt 7 and the secondary transfer belt 9 to prevent color misregistration from occurring. FIG. 5 is a view for illustrating registration patches 23*a*, 23*b*, 23*c*, and 23*d* (pattern images for image position detection) formed on the intermediate transfer belt 7. After predetermined conditions are satisfied to execute the color registration correction, color misregistration detection control is executed. The predetermined conditions include, for example, after the image forming apparatus is turned on but before a first image is formed; when a predetermined number of images are formed in a case where images are continuously formed; and when environmental conditions (temperature, humidity) exceed set fluctuation amounts. In color misregistration detection, the registration patches 23*a*, 23*b*, 23*c*, and 23*d*, which are test images as illustrated in FIG. 5, are formed on the intermediate transfer belt 7. An on-belt image position detecting unit 28 (FIG. 1) is configured to detect positions of the registration patches 23*a*, 23*b*, 23*c*, and 23*d* on the intermediate transfer belt 7. Then, when an image is to be formed, an image writing position on the photosensitive drum 1 is corrected based on detection results in the on-belt image position detecting unit 28. The color misregistration detection is performed under the same conditions as actual image forming conditions except that no sheet P is conveyed. The image forming conditions include, for example, a transfer voltage, a difference in surface speed between the intermediate transfer belt 7 and the secondary transfer belt 9, and a pressurizing force applied to the intermediate transfer belt 7 by the secondary transfer belt 9.

When the sheet P enters the secondary transfer nip 35, the intermediate transfer belt 7 and the secondary transfer belt 9 require a force to convey the sheet P. A load torque acting on the intermediate transfer belt 7 and the secondary transfer belt 9 after the sheet P has entered the secondary transfer nip 35 is increased more than before the sheet P enters the secondary transfer nip 35. Particularly when the sheet P is a thick sheet, a sheet having a high stiffness, or a sheet having a large basis weight, the load torque acting on the intermediate transfer belt 7 and the secondary transfer belt 9 after the sheet P has entered the secondary transfer nip 35 is increased. When fluctuations in load torque before and after the sheet P enters the secondary transfer nip 35 is increased, a correspondence relationship between the rotational speed of the drive motor 21 and the surface speed Vb of the intermediate transfer belt 7, and a correspondence relationship between the rotational speed of the drive motor 22 and the surface speed V2*tr* of the secondary transfer belt 9 may be lost. Even under the state in which there is a difference between the surface speed Vb of the intermediate transfer belt 7 and the surface speed V2*tr* of the secondary transfer belt 9 as described above, correspondence relationships between the speeds in the drive transmission systems and the belt surface speeds (Vb, V2*tr*), respectively, may not be satisfied.

Specifically, the intermediate transfer belt 7 and the secondary transfer belt 9 are rotated under a state of being applied with a predetermined tension and stretched around the drive roller 8 and the drive roller 32 at a given contact angle, respectively. When the drive torque of the intermediate transfer belt 7 is increased, slippage occurs between the inner peripheral surface of the intermediate transfer belt 7 and the drive roller 8 against static frictional force between the inner peripheral surface of the intermediate transfer belt 7 and the drive roller 8. Further, when the drive torque of the secondary transfer belt 9 is increased, slippage occurs between an inner peripheral surface of the secondary transfer belt 9 and the drive roller 32 against static frictional force between the inner peripheral surface of the secondary transfer belt 9 and the drive roller 32. The slippage loses the correspondence relationship between the speed in the drive transmission system of the intermediate transfer belt 7 or the secondary transfer belt 9 and the belt surface speed (Vb or V2*tr*), and the surface speed Vb or V2*tr* of the intermediate transfer belt 7 or the secondary transfer belt 9 does not stabilize but fluctuates considerably. As a result, the surface speed Vb of the intermediate transfer belt 7 becomes different from the surface speed Vb at the time of color misregistration detection to cause color misregistration to occur even when an image is formed using color misregistration detection results, thus leading to deterioration of image quality. Further, the color misregistration amount varies depending on the paper type (material) of the sheet P.

Figure 6A:
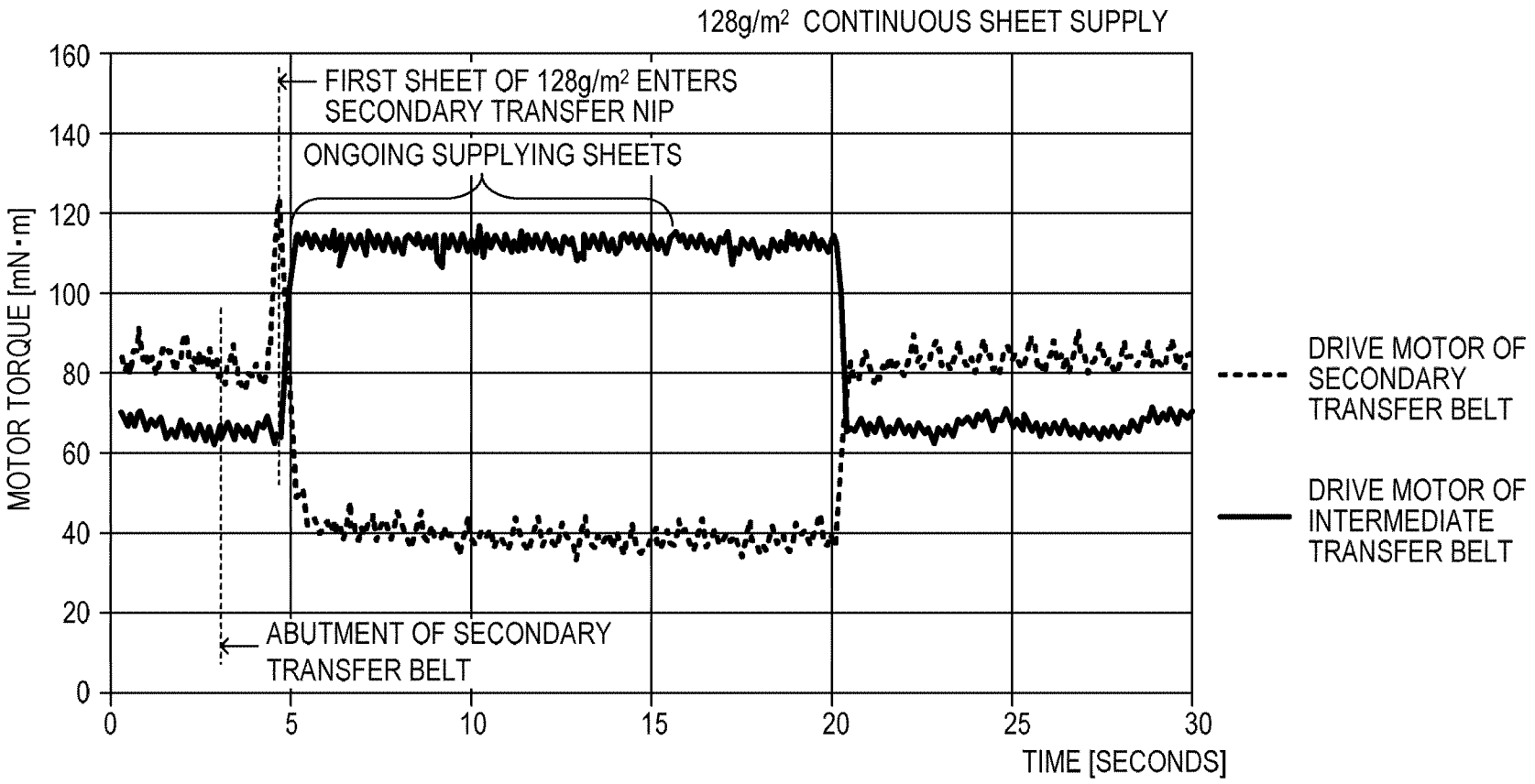
FIG. 6A and FIG. 6B are each a graph for showing torque fluctuations of drive motors during continuous image formation.
Figure 6B:
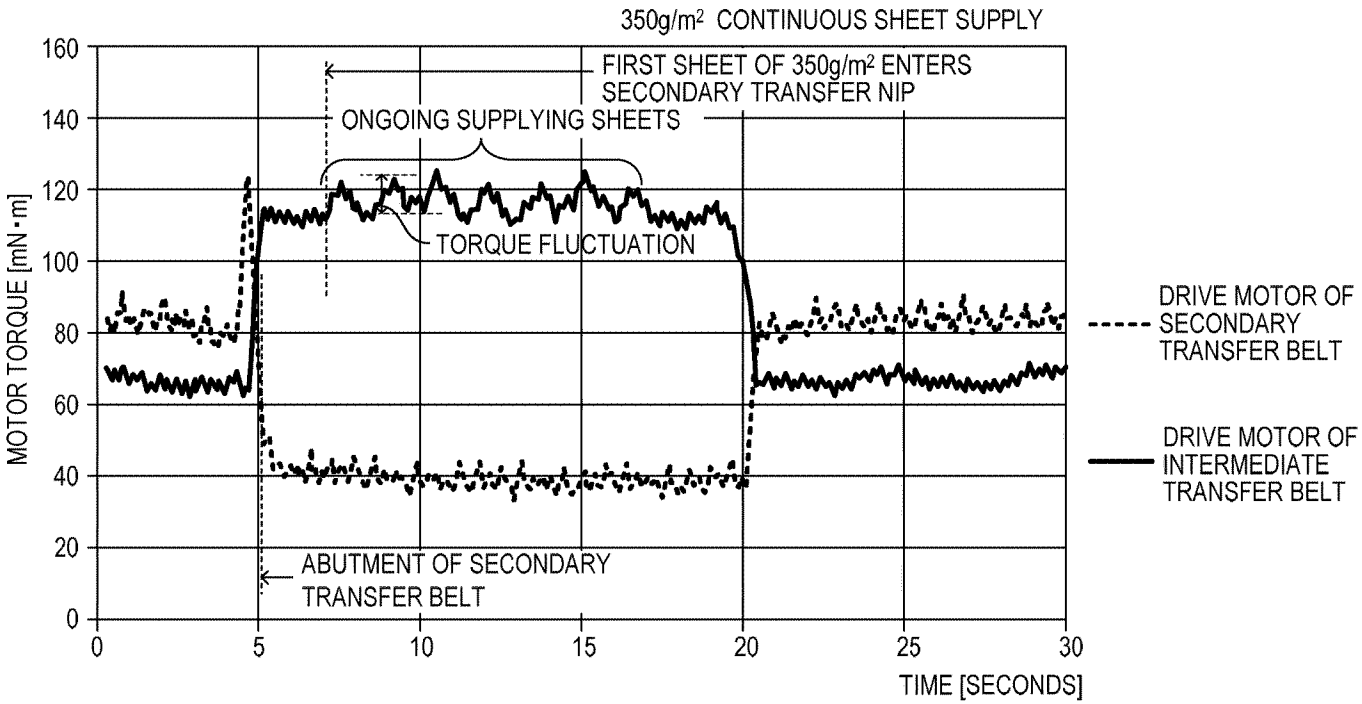

FIG. 6A and FIG. 6B are each a graph for showing torque fluctuations of the drive motors 21 and 22 during continuous image formation. FIG. 6A is a graph for showing torque fluctuations of the drive motor 21 for the drive roller 8 of the intermediate transfer belt 7 and the drive motor 22 for the drive roller 32 of the secondary transfer belt 9 when A3 sized sheets P having a basis weight of 128 g/m$^2$ are subjected to continuous image formation. FIG. 6B is a graph for showing torque fluctuations of the drive motors 21 and 22 when A3 sized sheets P having a basis weight of 350 g/m$^2$ are subjected to continuous image formation. Torque fluctuation measurement results in a case where the surface speed Vb of the intermediate transfer belt 7 is higher than the surface speed V2*tr* of the secondary transfer belt 9 (Vb>V2*tr*) are shown in FIG. 6A and FIG. 6B. In a case where a difference in surface speed is provided between the intermediate transfer belt 7 and the secondary transfer belt 9, even when a sheet P (a second type recording medium) having a small basis weight (128 g/m$^2$) enters the secondary transfer nip 35, torque fluctuations do not occur in the intermediate transfer belt 7, as shown in FIG. 6A. In contrast, when a sheet P (a first type recording medium) having a large basis weight (350 g/m$^2$) enters the secondary transfer nip 35, large torque fluctuations occur in the intermediate transfer belt 7, as shown in FIG. 6B.

Figure 7A:
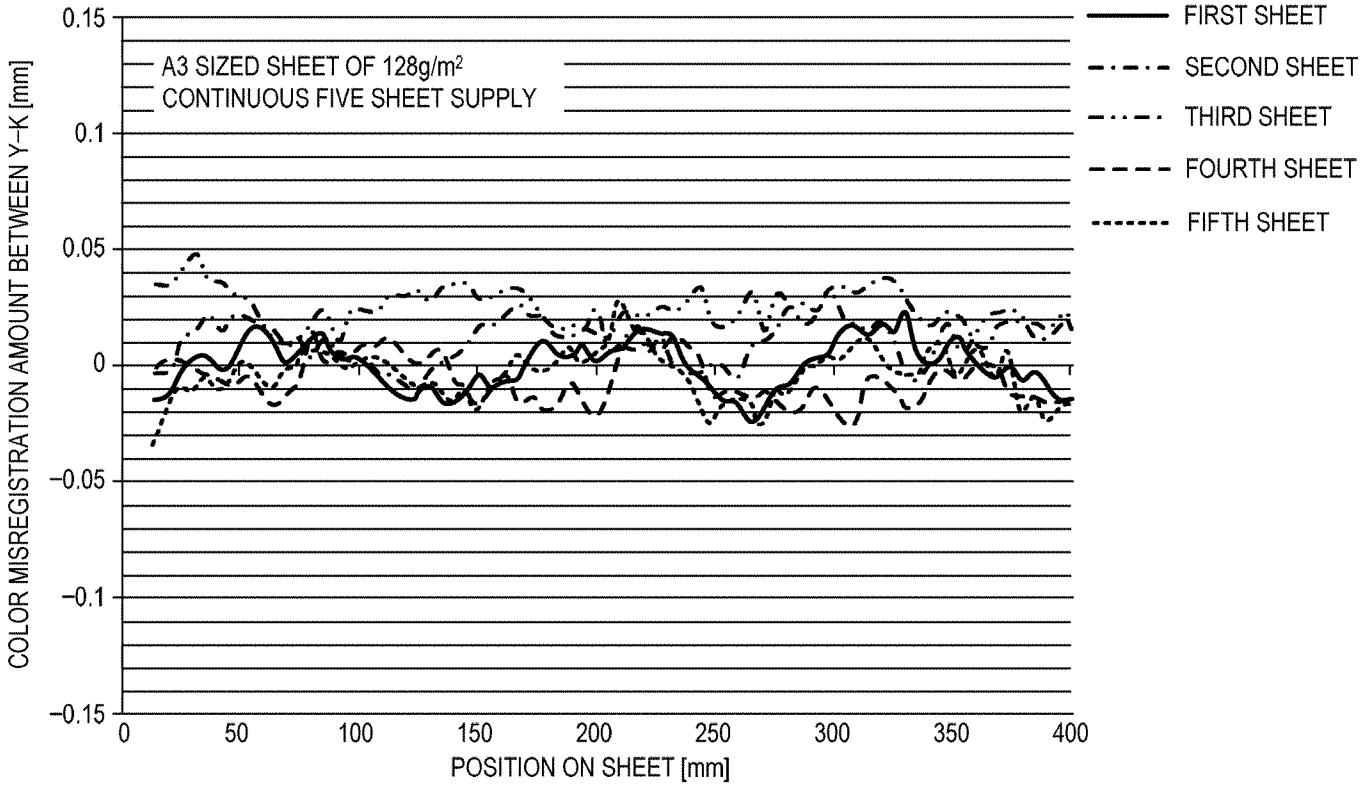
FIG. 7A and FIG. 7B are each a graph for showing color misregistration amounts between Y and K at positions on five sheets during continuous image formation.
Figure 7B:
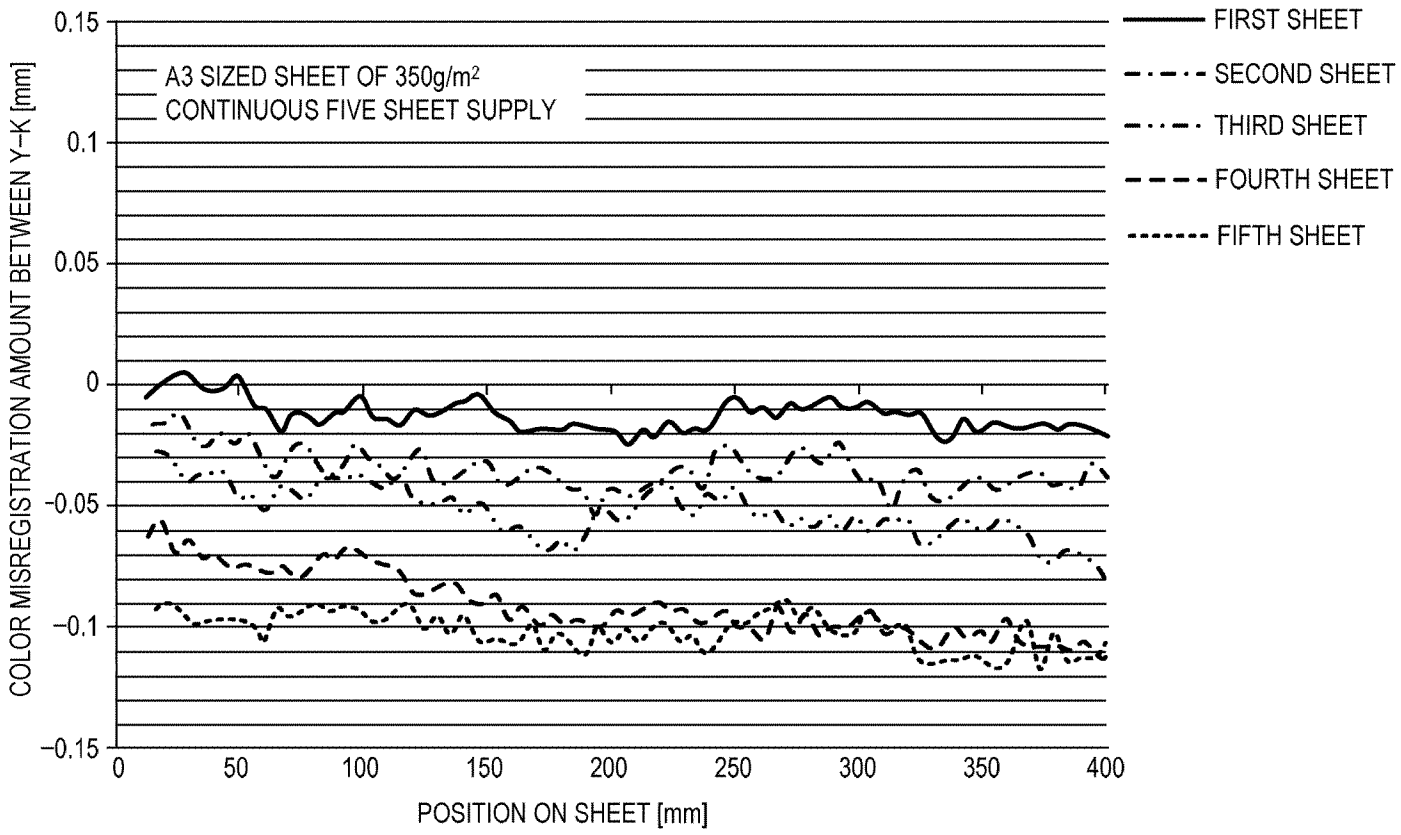

FIG. 7A and FIG. 7B are each a graph for showing color misregistration amounts between Y and K at positions on five sheets P during continuous image formation. FIG. 7A is a graph for showing the color misregistration amounts between Y and K (positional shift amounts in the sub-scanning direction of K images with respect to Y images) at positions on the sheets P (positions from leading end portions of the sheets P) during continuous image formation on the five A3 sized sheets having a basis weight of 128 g/m$^2$. FIG. 7B is a graph for showing the color misregistration amounts between Y and K at positions on the sheets P during continuous image formation on the five A3 sized sheets having a basis weight of 350 g/m$^2$. Measurement results of the color misregistration amounts between Y and K in images continuously formed on the first to fifth sheets P under a state in which the surface speed Vb of the intermediate transfer belt 7 is higher than the surface speed V2*tr* of the secondary transfer belt 9 (Vb>V2*tr*) are shown in FIG. 7A and FIG. 7B. Here, a case where a K image on a sheet P has color misregistration on a trailing end side of the sheet P with respect to a Y image is deemed positive in the vertical axis. According to the embodiment, when the first sheet P enters the secondary transfer nip 35, the primary transfer rollers 5*a*, 5*b*, 5*c*, and 5*d* already finish transferring toner images for the third sheet onto the intermediate transfer belt 7, respectively.

As is seen from FIG. 7A, in the case where the sheets P having a small basis weight (128 g/m$^2$) are subjected to continuous image formation under the state in which there is a difference in surface speed between the intermediate transfer belt 7 and the secondary transfer belt 9, the color misregistration amounts in the fourth sheet and its subsequent sheet are as small as the color misregistration amount in the first sheet. In contrast, as is seen from FIG. 7B, in the case where the sheets P having a large basis weight (350 g/m$^2$) are subjected to continuous image formation under the state in which there is a difference in surface speed between the intermediate transfer belt 7 and the secondary transfer belt 9, the color misregistration amounts in the fourth sheet and its subsequent sheet are larger than those in the first to third sheets. This is because when a sheet P having a large basis weight (350 g/m$^2$) enters the secondary transfer nip 35, large torque fluctuations occur in the drive motor 21 configured to drive the intermediate transfer belt 7 as shown in FIG. 6B, thus reducing the surface speed Vb of the intermediate transfer belt 7.

Figure 8:
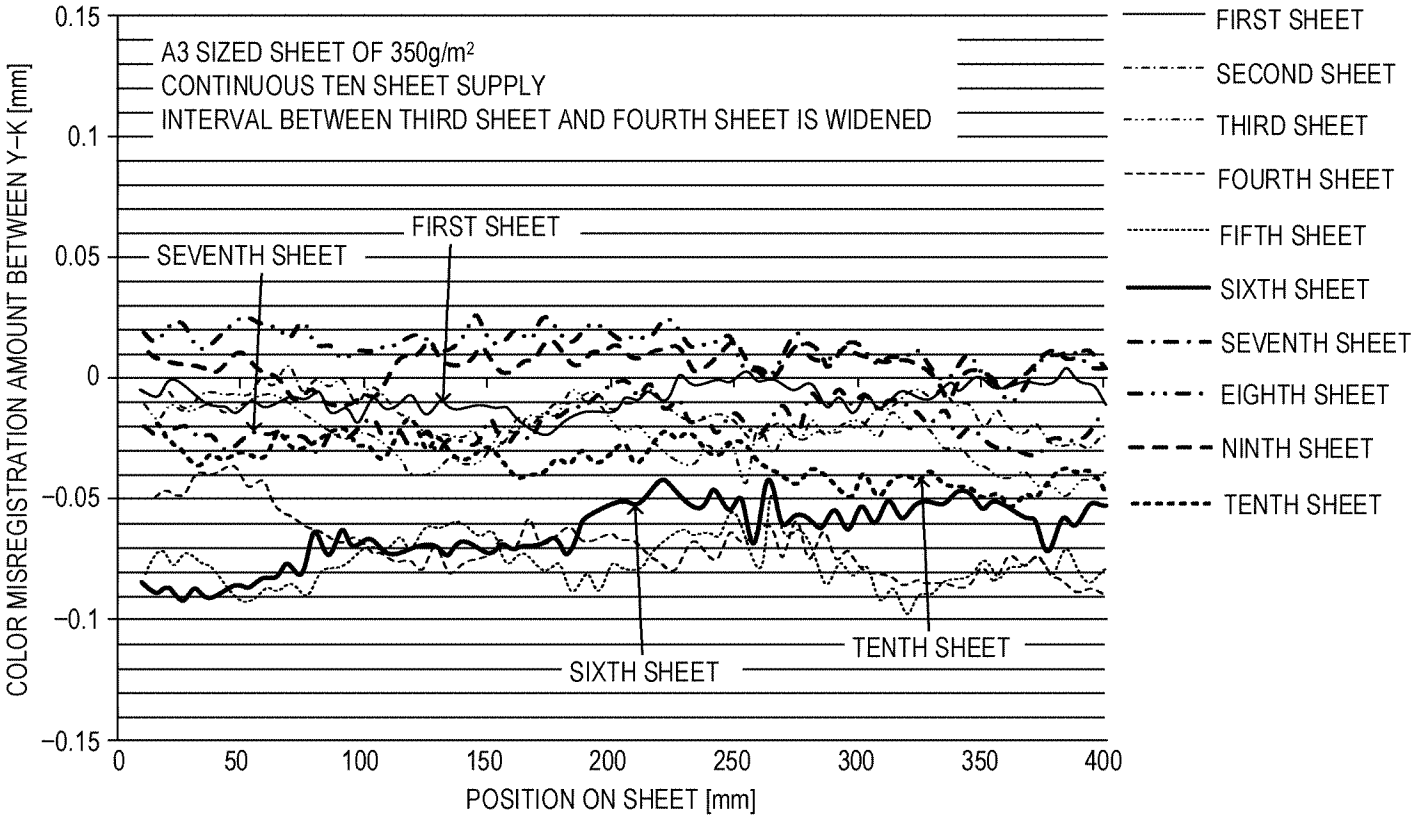
FIG. 8 is a graph for showing color misregistration amounts between Y and K at positions on ten sheets during continuous image formation.

FIG. 8 is a graph for showing color misregistration amounts between Y and K at positions on ten sheets P during continuous image formation. Measurement results of the color misregistration amounts between Y and K at positions on the ten A3 sized sheets P having a basis weight of 350 g/m$^2$ during continuous image formation are shown in FIG. 8. The measurement results are obtained by passing a third sheet P and a fourth sheet P with a large sheet-to-sheet interval forcibly provided therebetween. As is seen from FIG. 8, in the case where the sheet-to-sheet interval between the third sheet P and the fourth sheet P is forcibly increased (elongated), the color misregistration amount on a seventh sheet is as small as that in a first sheet. An image for a sixth sheet is already formed on the intermediate transfer belt 7 before the third sheet P enters the secondary transfer nip 35. Therefore, images for the fourth to sixth sheets have large color misregistration amounts due to an influence of the first to third sheets P entering the second transfer nip 35. However, after the third sheet P has passed through the secondary transfer nip 35, torque fluctuations of the drive motor 21 configured to drive the intermediate transfer belt 7 decrease and the surface speed Vb of the intermediate transfer belt 7 returns to a set value before the first sheet P enters the secondary transfer nip 35. The surface speed Vb of the intermediate transfer belt 7 is maintained at the set value until the fourth sheet P enters the secondary transfer nip 35. Therefore, the color misregistration amounts of images for the seventh to ninth sheets, which are formed on the intermediate transfer belt 7 from after the third sheet P passes through the secondary transfer nip 35 to before the fourth sheet P enters the secondary transfer nip 35, is as small as those of images for the first to third sheets. Then, when the fourth sheet P enters the secondary transfer nip 35, large torque fluctuations occur in the drive motor 21 configured to drive the intermediate transfer belt 7, thus reducing the surface speed Vb of the intermediate transfer belt 7. After that, an image for a tenth sheet formed on the intermediate transfer belt 7 has a large color misregistration amount due to an influence of the fourth sheet P entering the secondary transfer nip 35.

A method of reducing the color misregistration amount irrespective of a type and a passage state of the sheet P is described below in a case of continuous image formation under a state in which there is a difference between the surface speed Vb of the intermediate transfer belt 7 and the surface speed V2*tr* of the secondary transfer belt 9.

(Case of Single Job in which Sheets having Given Basis Weight are Continuously Passed)

Figure 9:
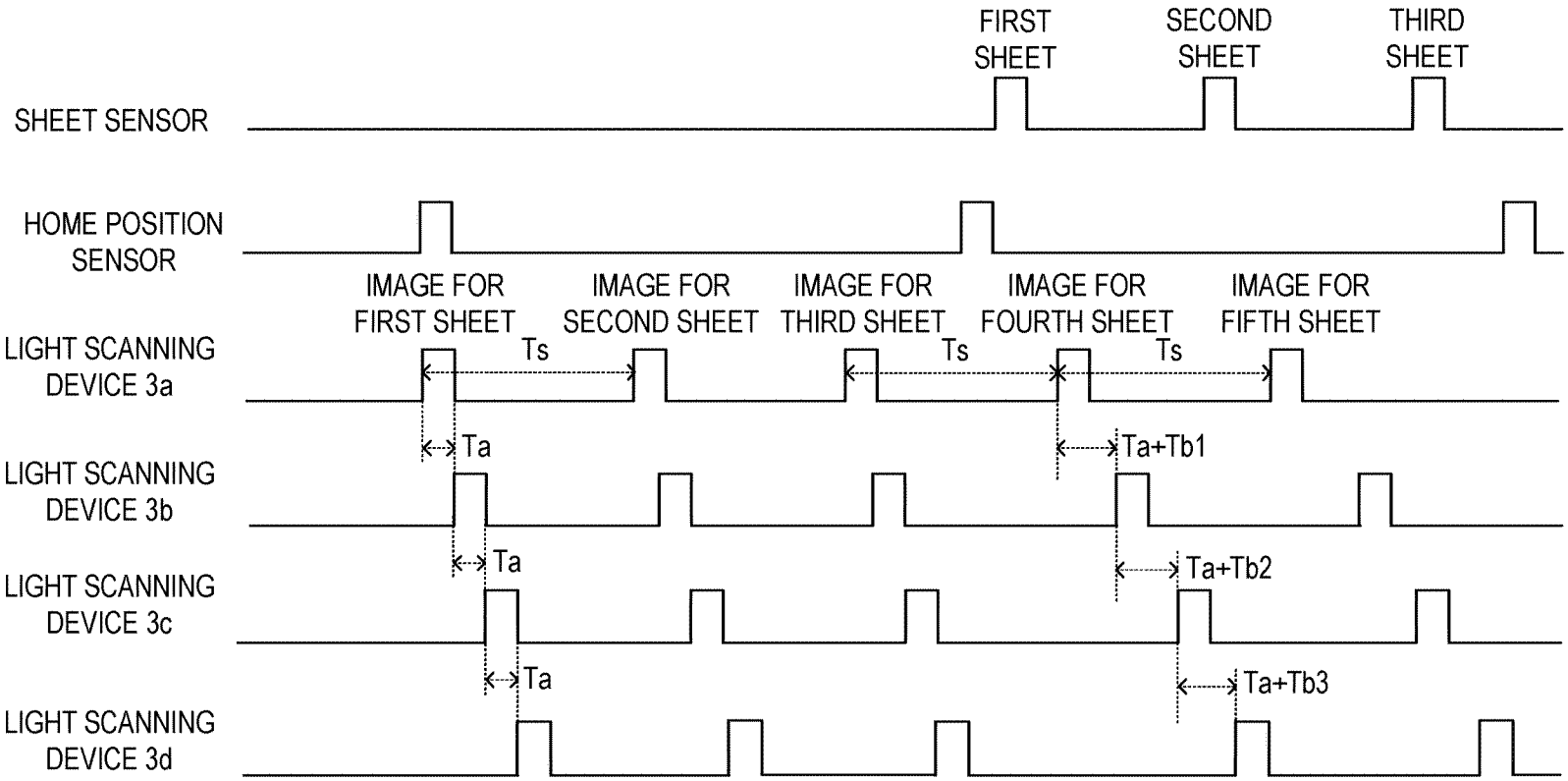
FIG. 9 is a timing chart in a case where images are continuously formed on sheets having a given basis weight.

FIG. 9 is a timing chart in a case where images are continuously formed on sheets P having a given basis weight. Operations of the sheet sensor 19 and the light scanning devices 3*a*, 3*b*, 3*c*, and 3*d* from start of sheet passage in a single job in which A3 sized sheets P having a given basis weight (e.g., 350 g/m$^2$) are continuously passed.

First, a user designates media information on sheets P to be passed. The media information includes at least one of the basis weight, thickness, stiffness, or surface state of the sheets P. Although the basis weight is described in the embodiment, the embodiment may also be applied to the thickness, stiffness and surface state. Upon start of sheet passage, the light scanning devices 3*a*, 3*b*, 3*c*, and 3*d* start writing electrostatic latent images (hereinafter sometimes referred to as "images") on the photosensitive drums 1*a*, 1*b*, 1*c*, and 1*d*. After an inter-drum time (first time period) Ta has passed from when the light scanning device 3*a* has started writing an image for a first sheet on the photosensitive drum (first photosensitive member) 1*a*, the light scanning device 3*b* starts writing an image for the first sheet on the photosensitive drum (second photosensitive member) 1*b*. The inter-drum time Ta as used herein is a time period obtained by dividing a horizontal distance (hereinafter referred to as "drum-to-drum distance") L between the adjacent photosensitive drums 1*a* and 1*b* by a process speed of the image forming apparatus 100. According to the embodiment, the process speed is a set value of the surface speed (first speed) Vb of the intermediate transfer belt 7 before the sheet P enters the secondary transfer nip 35. The process speed may be changed according to the media information.

According to the embodiment, the drum-to-drum distance between the photosensitive drums 1*b* and 1*c*, and the drum-to-drum distance between the photosensitive drums 1*c* and 1*d* are also the same as the drum-to-drum distance L between the photosensitive drums 1*a* and 1*b*. Therefore, after the inter-drum time Ta has passed from when the light scanning device 3*b* has started writing the image for the first sheet on the photosensitive drum 1*b*, the light scanning device 3*c* starts writing an image for the first sheet on the photosensitive drum 1*c*. After the inter-drum time Ta has passed from when the light scanning device 3*c* has started writing the image for the first sheet on the photosensitive drum 1*c*, the light scanning device 3*d* starts writing an image for the first sheet on the photosensitive drum 1*d*. In other words, the light scanning devices 3*a*, 3*b*, 3*c*, and 3*d* are set to sequentially start writing electrostatic latent images on the photosensitive drums 1*a*, 1*b*, 1*c*, and 1*d* at intervals of the inter-drum time (first time period) Ta.

Then, after a sheet-to-sheet interval corresponding time Ts has passed from when the light scanning device 3*a* has started writing the image for the first sheet on the photosensitive drum 1*a*, the light scanning device 3*a* starts writing an image for a second sheet on the photosensitive drum 1*a*. Subsequently, the light scanning devices 3 repeat the above-mentioned operations to write images on the photosensitive drums 1 until the sheet sensor 19 detects the first sheet P.

Each sheet P is fed from one of the sheet feed cassettes 11 through the corresponding sheet feed roller 25, and the posture of the sheet P is adjusted in the registration adjusting portion 12. The first sheet P is conveyed from the registration adjusting portion 12 toward the secondary transfer nip 35 at a timing synchronized with the toner image for the first sheet formed on the intermediate transfer belt 7. When the sheet sensor 19 arranged on the downstream side of the registration adjusting portion 12 detects the first sheet P during a continuous image forming operation, writing start timings in the light scanning devices 3*b*, 3*c*, and 3*d* are changed according to the media information on the sheet P designated by the user. Writing start timings in the light scanning devices 3*b*, 3*c*, and 3*d* are changed by rotation phase control of the motors 214 configured to rotate the rotary polygon mirrors 207 arranged in the light scanning devices 3*b*, 3*c*, and 3*d*, respectively, with respect to the motor 214 configured to rotate the rotary polygon mirror 207 arranged in the light scanning device 3*a*. The rotation phase control of the motors 214 is described later.

Toner images corresponding to a plurality of images are transferred onto the intermediate transfer belt 7 before the sheet sensor 19 detects the first sheet P. According to the embodiment, toner images corresponding to three images are transferred onto the intermediate transfer belt 7 before the sheet sensor 19 detects the first sheet P. After the sheet-to-sheet interval corresponding time Ts has passed from when the light scanning device 3*a* has started writing an image for a third sheet corresponding to the last toner image among the plurality of toner images transferred onto the intermediate transfer belt 7, the light scanning device 3*a* starts writing an image for a fourth sheet. At that time, the light scanning device 3*a* starts writing the image for the fourth sheet after the sheet sensor 19 detects the first sheet P.

After a time period which includes the inter-drum time Ta and a predetermined time period (first additional time) Tb1 set according to the media information has passed from when the light scanning device 3*a* has started writing the image for the fourth sheet on the photosensitive drum 1*a*, the light scanning device 3*b* starts writing an image for the fourth sheet on the photosensitive drum 1*b*. After a time period which includes the inter-drum time Ta and a predetermined time period (second additional time) Tb2 set according to the media information has passed from when the light scanning device 3*b* has started writing the image for the fourth sheet on the photosensitive drum 1*b*, the light scanning device 3*c* starts writing an image for the fourth sheet on the photosensitive drum 1*c*. After a time period which includes the inter-drum time Ta and a predetermined time period (third additional time) Tb3 set according to the media information has passed from when the light scanning device 3*c* has started writing the image for the fourth sheet on the photosensitive drum 1*c*, the light scanning device 3*d* starts writing an image for the fourth sheet on the photosensitive drum 1*d*.

In other words, setting is corrected so that the light scanning devices 3*a*, 3*b*, 3*c*, and 3*d* sequentially start writing electrostatic latent images on the photosensitive drums 1*a*, 1*b*, 1*c*, and 1*d* at intervals of a time period (second time period) Te which includes the inter-drum time Ta and the predetermined time period Tb1, Tb2, or Tb3. The time period Te which includes the inter-drum time Ta and the predetermined time period Tb1, Tb2, or Tb3 is larger than the inter-drum time (first time period) Ta. In other words, correction is made so that an exposure start timing of the photosensitive drum 1 is delayed more than an initially set timing. The predetermined time period Tb1, Tb2, or Tb3 is set according to the media information on the sheet P.

Then, after the sheet-to-sheet interval corresponding time Ts has passed from when the light scanning device 3*a* has started writing the image for the fourth sheet on the photosensitive drum 1*a*, the light scanning device 3*a* starts writing an image for a fifth sheet on the photosensitive drum 1*a*. Subsequently, until the end of the job, the light scanning devices 3*b*, 3*c*, and 3*d* repeat the above-mentioned operations for writing images on the photosensitive drums 1 after the time periods each including the inter-drum time Ta and the predetermined time period Tb1, Tb2, or Tb3 have passed.

The predetermined time periods Tb1, Tb2, and Tb3 may be set at the same value or be set separately. According to the embodiment, in a case where sheets having a basis weight of less than 128 g/m$^2$ are passed, the predetermined time periods Tb1, Tb2, and Tb3 for the writing start timings in the light scanning devices 3*b*, 3*c*, and 3*d* are set to satisfy Tb1=Tb2=Tb3=0 (initial value).

(Rotation Phase Control)

Figure 10A:
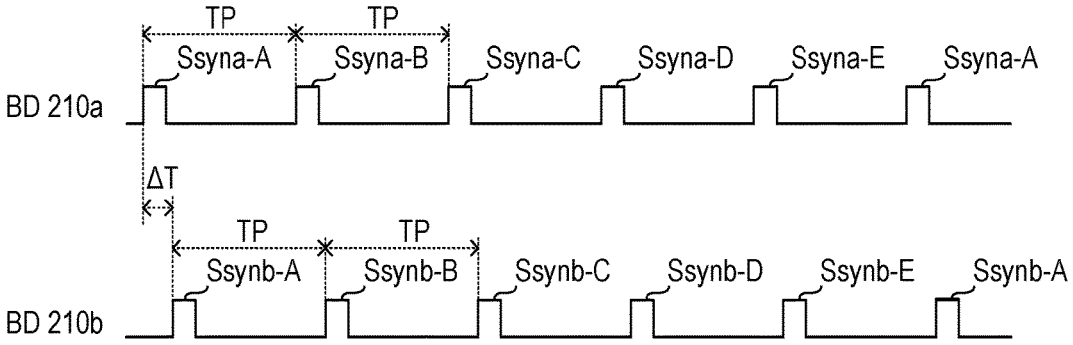
FIG. 10A and FIG. 10B are explanatory diagrams of rotation phase control of rotary polygon mirrors.
Figure 10B:
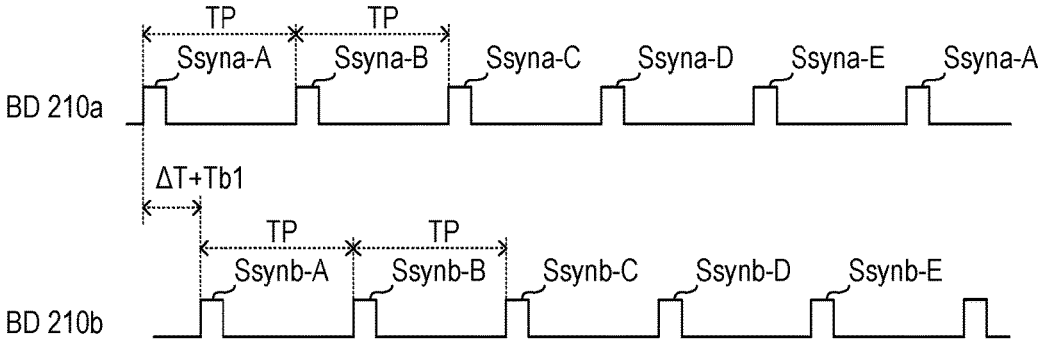

Rotation phase control for changing the timings of writing in the sub-scanning direction made by the light scanning devices 3*b*, 3*c*, and 3*d* is now described. According to the embodiment, a rotation phase of the rotary polygon mirror 207 is adjusted to shift a position of a light beam on the photosensitive drum 1 in the sub-scanning direction. FIG. 10A and FIG. 10B are explanatory diagrams of the rotation phase control of the rotary polygon mirror 207. For the sake of explanation, a synchronizing signal Ssyna of a BD 210*a* of the light scanning device 3*a* for yellow and a synchronizing signal Ssynb of a BD 210*b* of the light scanning device 3*b* for magenta are only illustrated in FIG. 10A and FIG. 10B. The rotary polygon mirror 207 has the five reflecting surfaces and synchronizing signals Ssyn-A, Ssyn-B, Ssyn-C, Ssyn-D and Ssyn-E correspond to the respective reflecting surfaces.

When the rotary polygon mirror 207 rotates at a predetermined rotational speed, the BD 210 outputs the synchronizing signal Ssyn at a predetermined period TP. The synchronizing signals Ssyna and Ssynb during rotation of rotary polygon mirrors 207*a* and 207*b* at a phase difference ΔT corresponding to the inter-drum time Ta are illustrated in FIG. 10A. In order to delay the writing start timing in the light scanning device 3*b* for magenta by the predetermined time period Tb1, the phase difference between the rotary polygon mirrors 207*a* and 207*b* is adjusted to ΔT+Tb1, as illustrated in FIG. 10B. Thus, a CPU 211*b* performs the rotation phase control of a motor 214*b* so that the rotational speed of the motor 214*b* for the rotary polygon mirror 207*b* is once reduced and is then increased to have the phase difference ΔT+Tb1 at the predetermined rotational speed. The timing of writing in the sub-scanning direction made by the light scanning device 3*b* can be shifted by Tb1.

The rotation phase control of motors 214*c* and 214*d* is also the same as that of the motor 214*b*, and hence a description thereof is omitted. The rotation phase control of the motor 214 is performed when no image is formed (during non-image formation). According to the embodiment, the rotation phase control of the motor 214 is performed after image formation on a third sheet P but before image formation on a fourth sheet P.

According to the embodiment, the rotation phase of the motor 214 for the rotary polygon mirror 207 is controlled to correct the timing of writing in the sub-scanning direction made by the light scanning device 3. However, an angle of the reflecting mirror 209 may be adjusted to correct the writing start timing. Alternatively, in a case where a shift amount in the writing start timing is large, the reflecting surface of the rotary polygon mirror 207 may be changed without adjusting the rotation phase. Further alternatively, in a case of the light scanning device 3 configured to simultaneously deflect a plurality of light beams emitted by the semiconductor laser 201, light emission timings at a plurality of light emission points in the semiconductor laser 201 may be adjusted.

(Phase Relationship of Synchronizing Signal Ssyn)

Figure 11A:
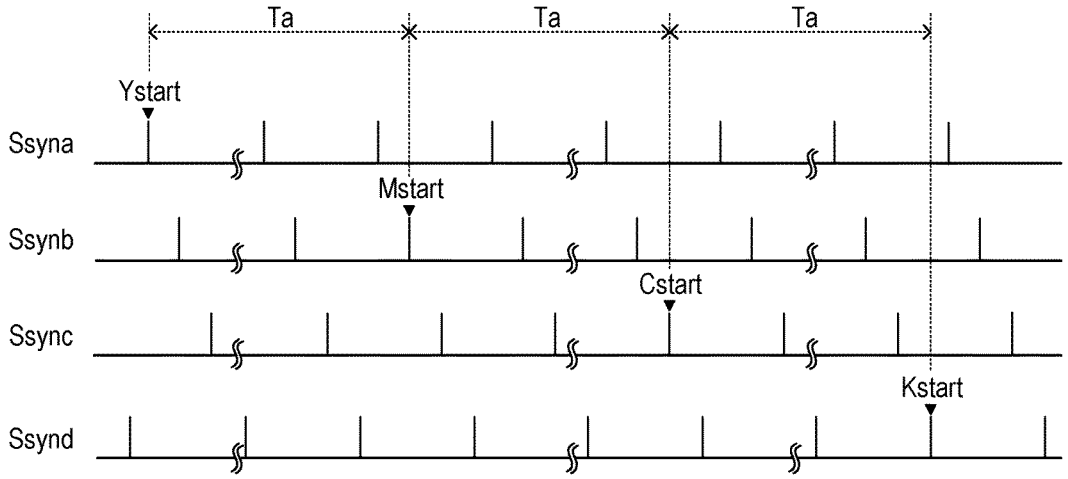
FIG. 11A and FIG. 11B are each a diagram for illustrating a phase relationship of synchronizing signals.
Figure 11B:
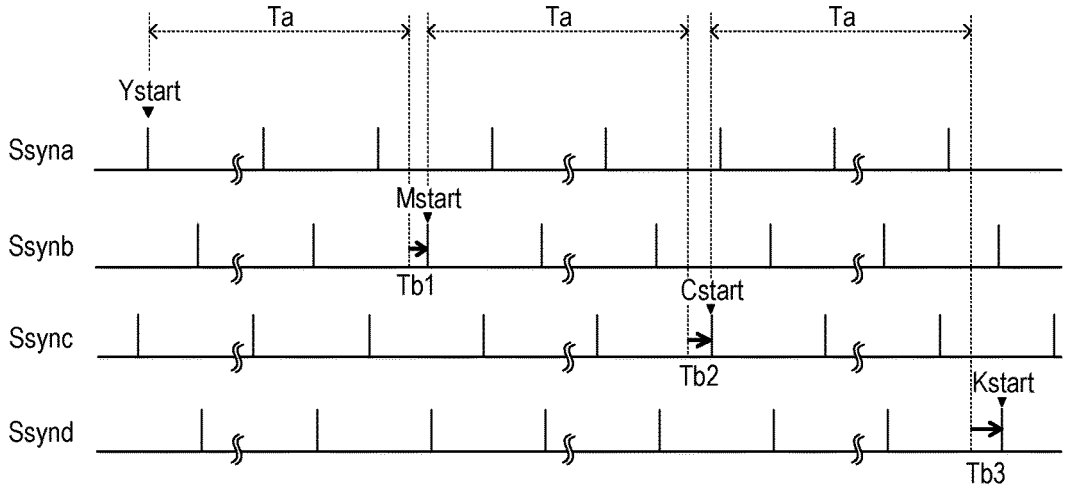

Next, a phase relationship of the synchronizing signals Ssyn according to the embodiment illustrated in FIG. 9 is described. FIG. 11A and FIG. 11B are each a diagram for illustrating the phase relationship of the synchronizing signals Ssyn. FIG. 11A is a diagram for illustrating the phase relationship of the synchronizing signals Ssyn in writing of images for first to third sheets. FIG. 11B is a diagram for illustrating the phase relationship of the synchronizing signals Ssyn in writing of images for a fourth sheet and its subsequent sheets. The synchronizing signal Ssyna is output from the BD 210*a* in the light scanning device 3*a* for yellow. The synchronizing signal Ssynb is output from the BD 210*b* in the light scanning device 3*b* for magenta. A synchronizing signal Ssync is output from a BD 210*c* in the light scanning device 3*c* for cyan. A synchronizing signal Ssynd is output from a BD 210*d* in the light scanning device 3*d* for black.

At a start of writing the images for the first to third sheets as illustrated in FIG. 11A, the light scanning devices 3*a*, 3*b*, 3*c*, and 3*d* sequentially start writing electrostatic latent images on the photosensitive drums 1*a*, 1*b*, 1*c*, and 1*d* at intervals of the inter-drum time Ta. In other words, a difference between a start $Y_{start}$ of image writing on the photosensitive drum 1*a* and a start $M_{start}$ of image writing on the photosensitive drum 1*b* is the inter-drum time Ta. A difference between the start $M_{start}$ of image writing on the photosensitive drum 1*b* and a start $C_{start}$ of image writing on the photosensitive drum 1*c* is also the inter-drum time Ta. A difference between the start $C_{start}$ of image writing on the photosensitive drum 1*c* and a start $K_{start}$ of image writing on the photosensitive drum 1*d* is also the inter-drum time Ta. The inter-drum time Ta depends on the distance between the respective photosensitive drums, the process speed, and a correction amount of the color misregistration.

At a start of writing the images for the fourth sheet and its subsequent sheets as illustrated in FIG. 11B, the difference between the start $Y_{start}$ of image writing on the photosensitive drum 1*a* and the start $M_{start}$ of image writing on the photosensitive drum 1*b* is the inter-drum time Ta+the predetermined time period Tb1. The difference between the start $M_{start}$ of image writing on the photosensitive drum 1*b* and the start $C_{start}$ of image writing on the photosensitive drum 1*c* is the inter-drum time Ta+the predetermined time period Tb2. The difference between the start $C_{start}$ of image writing on the photosensitive drum 1*c* and the start $K_{start}$ of image writing on the photosensitive drum 1*d* is the inter-drum time Ta+the predetermined time period Tb3.

(Method of Calculating Predetermined Time Periods Tb1, Tb2, and Tb3)

Next, a method of calculating the predetermined time periods Tb1, Tb2, and Tb3 is described. The predetermined time periods Tb1, Tb2, and Tb3 are set according to the media information. The media information includes at least one of the basis weight, thickness, stiffness, or surface state of the sheets P. Each of FIG. 12A, FIG. 12B, and FIG. 12C is a lookup table including media information and predetermined time periods Tb0, Tb1, Tb2, and Tb3. The lookup tables of FIG. 12A, FIG. 12B, and FIG. 12C are stored in the RAM 121. The predetermined time period Tb0 is a delay time for delaying the start $Y_{start}$ of image writing on the photosensitive drum 1*a* according to the media information. The predetermined time period Tb1 is a delay time for delaying the start $M_{start}$ of image writing on the photosensitive drum 1*b* according to the media information. The predetermined time period Tb2 is a delay time for delaying the start $C_{start}$ of image writing on the photosensitive drum 1*c* according to the media information. The predetermined time period Tb3 is a delay time for delaying the start $K_{start}$ of image writing on the photosensitive drum 1*d* according to the media information.

According to the embodiment, the predetermined time period Tb0 is set to 0 (zero) irrespective of the media information. According to the embodiment, the predetermined time periods Tb1, Tb2, and Tb3 are set according to the media information, as shown in FIG. 12A, FIG. 12B, and FIG. 12C. In a case where the basis weight of the sheet P is equal to or less than the predetermined value of 128 g/m$^2$, the predetermined time periods Tb0, Tb1, Tb2, and Tb3 are 0 (zero) because torque fluctuations do not occur in the intermediate transfer belt 7 when a sheet P having a basis weight equal to or less than the predetermined value of 128 g/m$^2$ enters the secondary transfer nip 35. However, torque fluctuations occur in the intermediate transfer belt 7 when a sheet P having a basis weight exceeding the predetermined value of 128 g/m$^2$ enters the secondary transfer nip 35. Therefore, the predetermined time periods Tb0, Tb1, Tb2, and Tb3 which are delay times are set. In a case where the basis weight is larger than the predetermined value of 128 g/m$^2$, the predetermined time periods Tb1, Tb2, and Tb3 are set to be longer for a larger basis weight of the sheet P. At the same basis weight, the predetermined time periods Tb1, Tb2, and Tb3 have a relationship of Tb1<Tb2<Tb3. A relationship between the media information and the predetermined time periods Tb0, Tb1, Tb2, and Tb3 as shown in FIG. 12A, FIG. 12B, and FIG. 12C is an example and the embodiment is not limited thereto. A relationship between media information on thick sheets and the predetermined time periods Tb0, Tb1, Tb2, and Tb3 is shown in FIG. 12A. A relationship between media information on single/both side coat sheets and the predetermined time periods Tb0, Tb1, Tb2, and Tb3 is shown in FIG. 12B. A relationship between media information on matt coated sheets and the predetermined time periods Tb0, Tb1, Tb2, and Tb3 is shown in FIG. 12C. The matt coated sheets are sheets which are less glossy than coat sheets. The CPU 211 sets the predetermined time periods Tb1, Tb2, and Tb3 based on the lookup tables shown in FIG. 12A, FIG. 12B, and FIG. 12C according to the media information.

(Calculation of Inter-Drum Time Ta)

Figure 13:
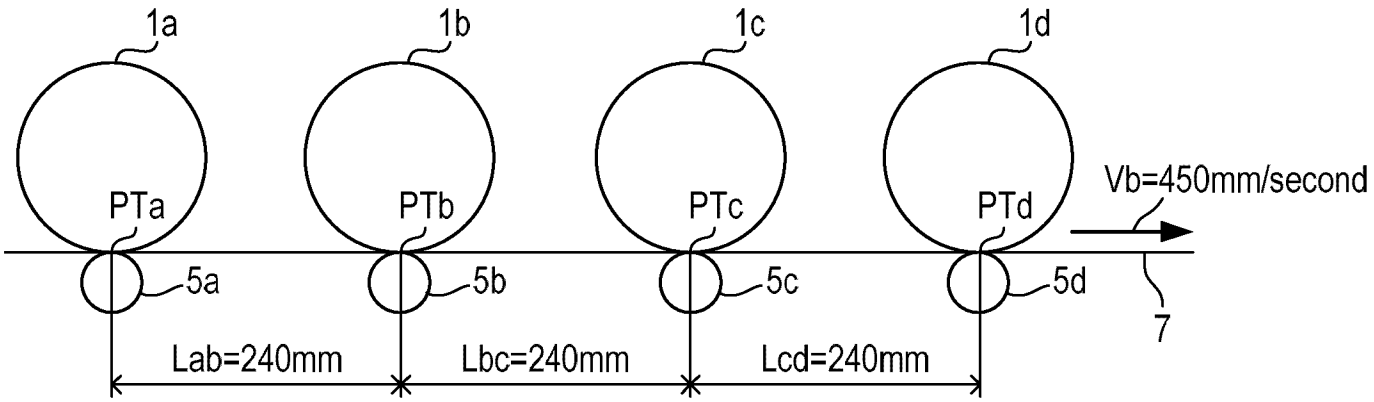
FIG. 13 is a diagram for illustrating an inter-drum time and a process speed.

Next, a method of calculating the inter-drum time Ta is described. The inter-drum time Ta is a time period obtained by dividing the drum-to-drum distance L by the process speed of the image forming apparatus 100. The process speed may be set according to the media information. FIG. 13 is a diagram for illustrating the inter-drum time Ta and the process speed Vb. The process speed Vb which is a moving speed of the intermediate transfer belt 7 is set to 450 mm/s. A drum-to-drum distance Lab between the adjacent photosensitive drums 1*a* and 1*b* is a distance between a primary transfer portion PTa formed by the photosensitive drum 1*a* and the primary transfer roller 5*a*, and a primary transfer portion PTb formed by the photosensitive drum 1*b* and the primary transfer roller 5*b*, and is set to 240 mm. A drum-to-drum distance Lbc between the adjacent photosensitive drums 1*b* and 1*c* is a distance between the primary transfer portion PTb and a primary transfer portion PTc formed by the photosensitive drum 1*c* and the primary transfer roller 5*c*, and is set to 240 mm. A drum-to-drum distance Lcd between the adjacent photosensitive drums 1*c* and 1*d* is a distance between the primary transfer portion PTc and a primary transfer portion PTd formed by the photosensitive drum 1*d* and the primary transfer roller 5*d*, and is set to 240 mm. The inter-drum time Ta is determined by the following expression:

$$Ta = \frac{Lab}{Vb} = \frac{Lbc}{Vb} = \frac{Lcd}{Vb} = \frac{240\text{ mm}}{450\text{ mm/second}} = 0.533[\text{second}]$$

According to the embodiment, a surface moving speed of the photosensitive drum 1 is set to 448 mm/s and is lower than the process speed Vb.

(Specific Example of Writing Start Timing in Light Scanning Device)

Next, a specific example of the writing start timings in the light scanning devices 3*b*, 3*c*, and 3*d* is described. In a case where the sheet P is a thick sheet 2 (129 to 150 g/m$^2$), based on the lookup tables in FIG. 12A, FIG. 12B, and FIG. 12C, Tb0 is 0 seconds, Tb1 is $5.60\times10^{-6}$ second, Tb2 is $8.45\times10^{-6}$ second, and Tb3 is $1.18\times10^{-5}$ second. The inter-drum time Ta is 0.533 second.

Start of image writing for first to third sheets is as follows. The start $M_{start}$ of image writing on the photosensitive drum 1*b* is after the inter-drum time Ta of 0.533 second from the start $Y_{start}$ of image writing on the photosensitive drum 1*a*. The start $C_{start}$ of image writing on the photosensitive drum 1*c* is after the inter-drum time Ta of 0.533 second from the start $M_{start}$ of image writing on the photosensitive drum 1*b*. The start $K_{start}$ of image writing on the photosensitive drum 1*d* is after the inter-drum time Ta of 0.533 second from the start $C_{start}$ of image writing on the photosensitive drum 1*c*.

Start of image writing for a fourth sheet and its subsequent sheets is as follows. The start $M_{start}$ of image writing on the photosensitive drum 1*b* is after 0.53300560 second (inter-drum time Ta of 0.533 second+predetermined time period Tb1 of $5.60\times10^{-6}$ second) from the start $Y_{start}$ of Th image writing on the photosensitive drum 1*a*. The start $C_{start}$ of image writing on the photosensitive drum 1*c* is after 0.53300845 second (inter-drum time Ta of 0.533 second+predetermined time period Tb2 of $8.45\times10^{-6}$ second) from the start $M_{start}$ of image writing on the photosensitive drum 1*b*. The start $K_{start}$ of image writing on the photosensitive drum 1*d* is after 0.53301180 second (inter-drum time Ta of 0.533 second+predetermined time period Tb3 of $1.18\times10^{-5}$ second) from the start $C_{start}$ of image writing on the photosensitive drum 1*c*.

The delay of the predetermined time period Tb1 of $5.60\times10^{-6}$ second is 2.5 μm in terms of the distance on the photosensitive drum 1*b*. The delay of the predetermined time period Tb2 of $8.45\times10^{-6}$ second is 3.8 μm in terms of the distance on the photosensitive drum 1*c*. The delay of the predetermined time period Tb3 of $1.18\times10^{-5}$ second is 5.3 μm in terms of the distance on the photosensitive drum 1*d*. A distance between scanning lines is 10.6 μm at a resolution of 2,400 dpi, and hence an image writing start period is corrected by the rotation phase control of the motor 214 instead of changing the reflecting surface of the rotary polygon mirror 207.

(Case of Sheet-Mixed Job in which Sheets Classified into Two or more Types in Basis Weight are Continuously Passed)

Figure 14:
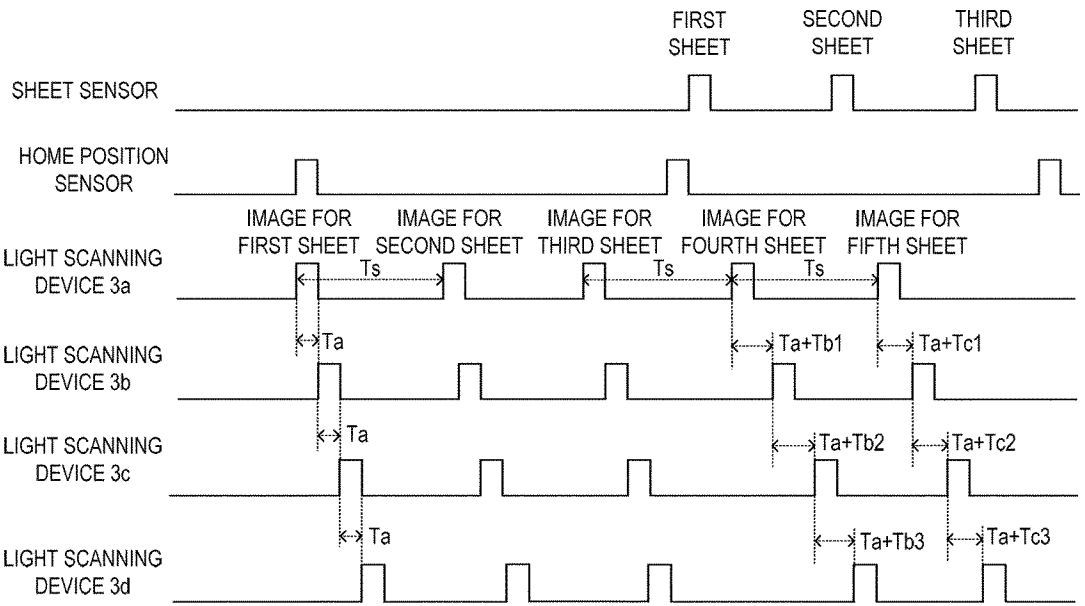
FIG. 14 is a timing chart in a case where images are continuously formed on sheets classified into two types in basis weight.

Next, a sheet-mixed job using sheets classified into two or more types in basis weight is described. FIG. 14 is a timing chart in a case where images are continuously formed on sheets P classified into two types in basis weight. In FIG. 14, there are illustrated operations of the sheet sensor 19 and the light scanning devices 3*a*, 3*b*, 3*c*, and 3*d* from a start of sheet passage in the sheet-mixed job in which A3 sized sheets P classified into two types in basis weight (e.g., 350 g/m$^2$ and 157 g/m$^2$) are continuously passed in an alternate manner. Two types of basis weights are described in the embodiment. However, the embodiment can also be applied to three or more types of basis weights.

First, a user designates media information MI1 (basis weight: 350 g/m$^2$) and media information MI2 (basis weight: 157 g/m$^2$) of two types of sheets P to be passed. Upon start of sheet passage, the light scanning devices 3*a*, 3*b*, 3*c*, and 3*d* start writing images on the photosensitive drums 1*a*, 1*b*, 1*c*, and 1*d*, respectively. After the inter-drum time Ta has passed from when the light scanning device 3*a* has started writing an image for a first sheet on the photosensitive drum 1*a*, the light scanning device 3*b* starts writing an image for the first sheet on the photosensitive drum 1*b*. After the inter-drum time Ta has passed from when the light scanning device 3*b* has started writing the image for the first sheet on the photosensitive drum 1*b*, the light scanning device 3*c* starts writing an image for the first sheet on the photosensitive drum 1*c*. After the inter-drum time Ta has passed from when the light scanning device 3*c* has started writing the image for the first sheet on the photosensitive drum 1*c*, the light scanning device 3*d* starts writing an image for the first sheet on the photosensitive drum 1*d*.

Then, after the sheet-to-sheet interval corresponding time Ts has passed from when the light scanning device 3*a* has started writing the image for the first sheet on the photosensitive drum 1*a*, the light scanning device 3*a* starts writing an image for a second sheet on the photosensitive drum 1*a*. Subsequently, the light scanning devices 3 repeat the above-mentioned operations to write images on the photosensitive drums 1 until the sheet sensor 19 detects the first sheet P.

Each sheet P is fed from one of the sheet feed cassettes 11 through the corresponding sheet feed roller 25, and the posture of the sheet P is adjusted in the registration adjusting portion 12. The first sheet P is conveyed from the registration adjusting portion 12 toward the secondary transfer nip 35 at a timing synchronized with the toner image for the first sheet formed on the intermediate transfer belt 7. When the sheet sensor 19 arranged on the downstream side of the registration adjusting portion 12 detects the first sheet P, writing start timings in the light scanning devices 3*b*, 3*c*, and 3*d* are changed according to the media information MI1 and MI2 of the sheet P designated by the user.

A plurality of toner images are transferred onto the intermediate transfer belt 7 before the sheet sensor 19 detects the first sheet P. According to the embodiment, three toner images are transferred onto the intermediate transfer belt 7 before the sheet sensor 19 detects the first sheet P. After the sheet-to-sheet interval corresponding time Ts has passed from when the light scanning device 3*a* has started writing an image for a third sheet corresponding to the last toner image among the plurality of toner images transferred onto the intermediate transfer belt 7, the light scanning device 3*a* starts writing an image for a fourth sheet. After a time period which includes the inter-drum time Ta and the predetermined time period Tb1 set according to the media information MI1 of the sheet P designated by the user has passed from when the light scanning device 3*a* has started writing the image for the fourth sheet on the photosensitive drum 1*a*, the light scanning device 3*b* starts writing an image for the fourth sheet on the photosensitive drum 1*b*. After a time period which includes the inter-drum time Ta and the predetermined time period Tb2 set according to the media information MI1 of the sheet P designated by the user has passed from when the light scanning device 3*b* has started writing the image for the fourth sheet on the photosensitive drum 1*b*, the light scanning device 3*c* starts writing an image for the fourth sheet on the photosensitive drum 1*c*. After a time period which includes the inter-drum time Ta and the predetermined time period Tb3 set according to the media information MI1 of the sheet P designated by the user has passed from when the light scanning device 3*c* has started writing the image for the fourth sheet on the photosensitive drum 1*c*, the light scanning device 3*d* starts writing an image for the fourth sheet on the photosensitive drum 1*d*.

Then, after the sheet-to-sheet interval corresponding time Ts has passed from when the light scanning device 3*a* has started writing the image for the fourth sheet on the photosensitive drum 1*a*, the light scanning device 3*a* starts writing an image for a fifth sheet on the photosensitive drum 1*a*. After a time period which includes the inter-drum time Ta and the predetermined time period Tcl set according to the media information MI2 of the sheet P designated by the user has passed from when the light scanning device 3*a* has started writing the image for the fifth sheet on the photosensitive drum 1*a*, the light scanning device 3*b* starts writing an image for the fifth sheet on the photosensitive drum 1*b*. After a time period which includes the inter-drum time Ta and the predetermined time period Tc2 set according to the media information MI2 of the sheet P designated by the user has passed from when the light scanning device 3*b* has started writing the image for the fifth sheet on the photosensitive drum 1*b*, the light scanning device 3*c* starts writing an image for the fifth sheet on the photosensitive drum 1*c*. After a time period which includes the inter-drum time Ta and the predetermined time period Tc3 set according to the media information MI2 of the sheet P designated by the user has passed from when the light scanning device 3*c* has started writing the image for the fifth sheet on the photosensitive drum 1*c*, the light scanning device 3*d* starts writing an image for the fifth sheet on the photosensitive drum 1*d*.

In the subsequent operation, the predetermined time period Tb1, Tb2, or Tb3, or the predetermined time period Tc1, Tc2, or Tc3 according to the media information MI1 or MI2 is added to the inter-drum time Ta. Until the end of the job, each of the light scanning devices 3*b*, 3*c*, and 3*d* repeats the above-mentioned operation for writing images on the photosensitive drum 1 after the time period which includes the inter-drum time Ta and the predetermined time period Tb1, Tb2, or Tb3, or the predetermined time period Tc1, Tc2, or Tc3.

The predetermined time periods Tb1, Tb2, and Tb3 may be set at the same value or be set separately. The predetermined time periods Tc1, Tc2, and Tc3 may also be set at the same value or be set separately. According to the embodiment, the predetermined time periods Tb1, Tb2, and Tb3, and the predetermined time periods Tc1, Tc2, and Tc3 are set based on the lookup tables in FIG. 12A, FIG. 12B, and FIG. 12C according to the media information MI1 and MI2. In a case where sheets having a basis weight of less than 129 g/m$^2$ are to be passed, the predetermined time periods Tb1 to Tc3 for the writing start timings in the light scanning devices 3*b*, 3*c*, and 3*d* are set to satisfy Tb1=Tb2=Tb3=Tc1=Tc2=Tc3=0 (initial value).

(Case where Sheet-to-Sheet Interval is Increased in Single Job in which Sheets having given Basis Weight are Continuously Passed)

There may be a large (long) sheet-to-sheet interval due to an interrupt operation of the image forming apparatus 100 at a given timing during a continuous image forming operation. For example, during image formation based on an image forming job for forming images on a plurality of sheets, the image forming apparatus 100 forms the registration patches 23*a*, 23*b*, 23*c*, and 23*d* on the intermediate transfer belt 7 according to the cumulative number of formed images, the number of continuously formed images, or an environmental condition (in temperature or humidity) of a predetermined amount or more (execution of calibration). For example, a plurality of sets of the registration patches 23*a*, 23*b*, 23*c*, and 23*d* are formed over the whole periphery of the intermediate transfer belt 7. The sheet-to-sheet interval is a feed time interval from a time when a sheet (preceding sheet) P is fed from the sheet feed cassette 11 to a time when a succeeding sheet P is fed (conveyance time interval). In a case where the registration patches 23*a*, 23*b*, 23*c*, and 23*d* are to be formed on the intermediate transfer belt 7, image formation on sheets are interrupted. In other words, in the case where the registration patches 23*a*, 23*b*, 23*c*, and 23*d* are to be formed on the intermediate transfer belt 7, the sheet-to-sheet interval is increased with respect to that during image formation on sheets. The sheet-to-sheet interval can be detected by a sheet detection unit (not shown) arranged downstream of the sheet feed roller 25. When images are continuously formed on sheets, speed fluctuations occur in the intermediate transfer belt 7 before and after the sheets P enter the secondary transfer nip 35. However, in a case where the image formation on the sheets is interrupted as a result of execution of calibration to increase the sheet-to-sheet interval, speed fluctuations occur again before and after the sheets enter the transfer nip after the image formation on the sheets is resumed. Therefore, when the sheet-to-sheet interval is increased by the execution of the calibration, toner images transferred onto the intermediate transfer belt 7 before first several sheets P after resuming the image formation on the sheets enter the secondary transfer nip 35 have no color misregistration caused by the speed fluctuations of the intermediate transfer belt 7 due to the sheets entering the transfer nip. Therefore, when the sheet-to-sheet interval is increased by the execution of the calibration and the image formation on the sheets is resumed, if an image is formed before a first sheet enters the transfer nip while shifting the writing start timing in the light scanning device 3 in the same manner as before the sheet-to-sheet interval is increased, color misregistration occurs in the image.

In a case where the sheet-to-sheet interval is increased, it is also conceivable to increase or decrease the speed of the intermediate transfer belt 7. For example, in a case of a media-mixed job in which images are continuously formed on many types of sheets P, the surface speed Vb of the intermediate transfer belt 7 is increased or decreased between sheets depending on the media type. However, when the sheet P is a small-sized sheet (e.g., postcard), the sheet-to-sheet interval is very short, and hence the surface speed Vb of the intermediate transfer belt 7 may not follow the short sheet-to-sheet interval even when a speed change signal is transmitted to the drive motor 21 for the intermediate transfer belt 7. Further, the surface speed Vb of the intermediate transfer belt 7 may not be changed to a target value.

Then, according to the embodiment, when the sheet-to-sheet interval exceeds a predetermined sheet-to-sheet interval during a continuous image forming operation, the writing start timing in the light scanning device 3 is returned to the inter-drum time Ta. Then, after a succeeding sheet P enters the secondary transfer nip 35, writing in the light scanning device 3 is started based on a time period in which a correction amount is added to the inter-drum time Ta.

Figure 15:
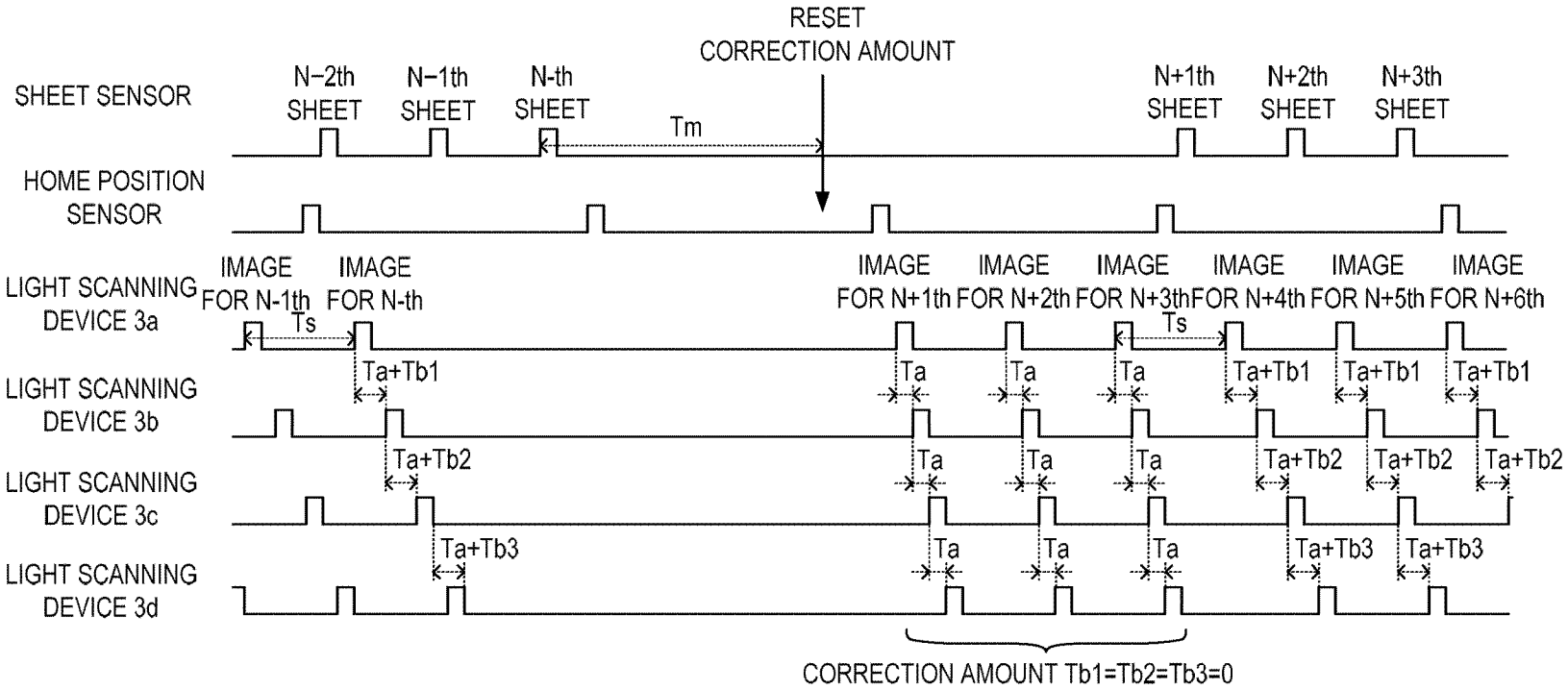
FIG. 15 is a timing chart in a case where a sheet-to-sheet interval is increased during a continuous image forming operation.

FIG. 15 is a timing chart in a case where the sheet-to-sheet interval is increased during a continuous image forming operation. In FIG. 15, there are illustrated operations of the sheet sensor 19 and the light scanning devices 3*a*, 3*b*, 3*c*, and 3*d* in a case where the sheet-to-sheet interval between an N-th sheet and an N+1th sheet is equal to or larger than a reference time period in a single job in which A3 sized sheets P having a given basis weight (e.g., 350 g/m$^2$) are continuously passed.

First, a user designates media information on sheets P to be passed. According to the embodiment, a case is described where the sheet-to-sheet interval between the N-th sheet P and the N+1th sheet P is equal to or larger than the reference time period during continuous sheet passage. The reference time period (hereinafter referred to as "predetermined time period") Tm is larger than the sheet-to-sheet interval corresponding time Ts (Tm>Ts). According to the embodiment, the predetermined time period Tm is set to a time period corresponding to one round of the intermediate transfer belt 7 (one round time). However, the predetermined time period Tm is not limited thereto. A state in which the sheet-to-sheet interval between the N-th sheet P and the N+1th sheet P is considerably increased during the continuous sheet passage is recognized by the CPU 211. For example, when the upper-side sheet feed cassette 11 is changed over to the lower-side sheet feed cassette 11 because there is no sheet P in the upper-side sheet feed cassette 11 after the N-th sheet P is fed during the continuous image formation, the CPU 211 recognizes that the sheet-to-sheet interval between the N-th sheet P and the N+1th sheet P may considerably increase.

Upon start of sheet passage, the light scanning devices 3*a*, 3*b*, 3*c*, and 3*d* start writing images on the photosensitive drums 1*a*, 1*b*, 1*c*, and 1*d* at the timings illustrated in FIG. 15. As illustrated in FIG. 15, after the sheet-to-sheet interval corresponding time Ts has passed from when the light scanning device 3*a* has started writing an image for an N-lth sheet on the photosensitive drum 1*a*, the light scanning device 3*a* starts writing an image for the N-th sheet on the photosensitive drum 1*a*. After a time period which includes the inter-drum time Ta and the predetermined time period Tb1 set according to the media information on the sheet P designated by the user has passed from when the light scanning device 3*a* has started writing the image for the N-th sheet on the photosensitive drum 1*a*, the light scanning device 3*b* starts writing an image for the N-th sheet on the photosensitive drum 1*b*. After a time period which includes the inter-drum time Ta and the predetermined time period Tb2 set according to the media information has passed from when the light scanning device 3*b* has started writing the image for the N-th sheet on the photosensitive drum 1*b*, the light scanning device 3*c* starts writing an image for the N-th sheet on the photosensitive drum 1*c*. After a time period which includes the inter-drum time Ta and the predetermined time period Tb3 set according to the media information has passed from when the light scanning device 3*c* has started writing the image for the N-th sheet on the photosensitive drum 1*c*, the light scanning device 3*d* starts writing an image for the N-th sheet on the photosensitive drum 1*d*.

Next, because the sheet-to-sheet interval between the N-th sheet and the N+1th sheet is equal to or larger than the predetermined time period Tm, the predetermined time periods (correction amounts) Tb1, Tb2, and Tb3 according to the media information are set to zero, respectively. The light scanning device 3*a* starts writing an image for the N+1th sheet on the photosensitive drum 1*a* according to a feed timing of the N+1th sheet. After the light scanning device 3*a* starts writing the image for the N+1th sheet on the photosensitive drum 1*a*, the light scanning devices 3*b*, 3*c*, and 3*d* start writing images after the inter-drum time Ta to which the predetermined time periods (correction amounts) Tb1, Tb2, and Tb3 are not added, respectively (reset mechanism). Until the sheet sensor 19 detects the N+1th sheet, the light scanning devices 3*b*, 3*c*, and 3*d* write images on the photosensitive drums 1 after the inter-drum times Ta to which the predetermined time periods Tb1, Tb2, and Tb3 are not added, respectively.

According to the embodiment, the light scanning device 3 starts writing an image for an N+3th sheet on the photosensitive drum 1 before the sheet sensor 19 detects the N+1th sheet. After the sheet-to-sheet interval corresponding time Ts has passed from when the light scanning device 3*a* has started writing an image for the N+3th sheet on the photosensitive drum 1*a*, the light scanning device 3*a* starts writing an image for an N+4th sheet on the photosensitive drum 1*a*. After a time period which includes the inter-drum time Ta and the predetermined time period Tb1 set according to the media information on the sheet P designated by the user has passed from when the light scanning device 3*a* has started writing the image for the N+4th sheet on the photosensitive drum 1*a*, the light scanning device 3*b* starts writing an image for the N+4th sheet on the photosensitive drum 1*b*. After a time period which includes the inter-drum time Ta and the predetermined time period Tb2 set according to the media information on the sheet P designated by the user has passed from when the light scanning device 3*b* has started writing the image for the N+4th sheet on the photosensitive drum 1*b*, the light scanning device 3*c* starts writing an image for the N+4th sheet on the photosensitive drum 1*c*. After a time period which includes the inter-drum time Ta and the predetermined time period Tb3 set according to the media information on the sheet P designated by the user has passed from when the light scanning device 3*c* has started writing the image for the N+4th sheet on the photosensitive drum 1*c*, the light scanning device 3*d* starts writing an image for the N+4th sheet on the photosensitive drum 1*d*.

Subsequently, until the end of the job, the light scanning devices 3*b*, 3*c*, and 3*d* repeat the operations for writing images on the photosensitive drums 1 after the time periods including the inter-drum time Ta and the predetermined time periods (correction amounts) Tb1, Tb2, and Tb3, respectively.

(Correction of Exposure Start Timing)

Figure 16:
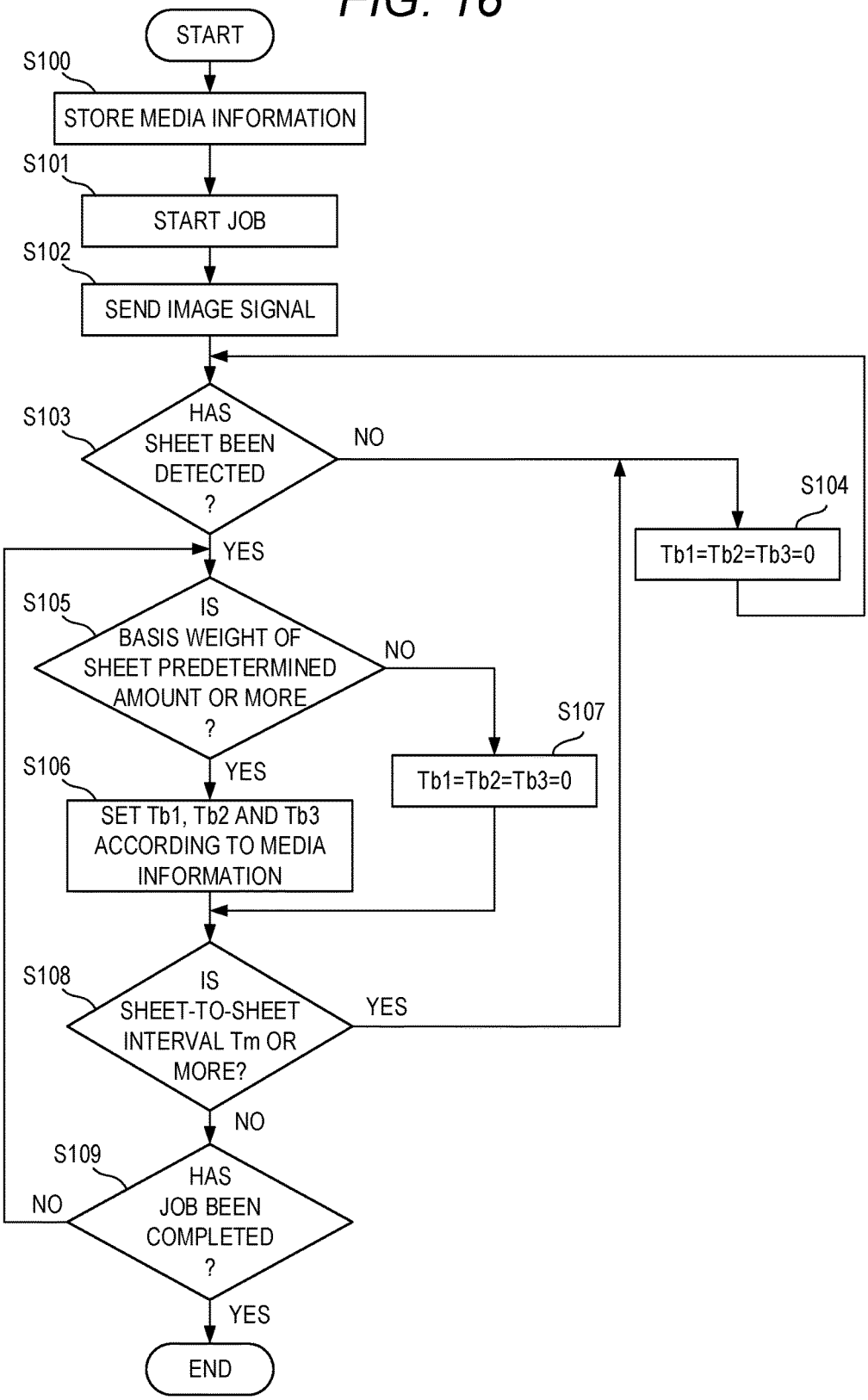
FIG. 16 is a flow chart for illustrating an operation for correcting an exposure start timing using the control system.

FIG. 16 is used to describe correction of exposure start timing according to the embodiment. FIG. 16 is a flow chart for illustrating an operation for correcting the exposure start timing using the control system 200. When media information on a sheet P on which an image is to be formed is designated by a user, the device controller portion 120 stores the media information designated by the user in the RAM 121 (Step S100). When a job is started (Step S101), the CPU 211 sends image signals to the light scanning devices 3*a*, 3*b*, 3*c*, and 3*d* (Step S102). The light scanning devices 3*a*, 3*b*, 3*c*, and 3*d* emit light beams based on the respective image signals to form images (electrostatic latent images) for a first sheet on the photosensitive drums 1*a*, 1*b*, 1*c*, and 1*d*, respectively. In this case, the light scanning devices 3*b*, 3*c*, and 3*d* start writing the images for the first sheet at intervals of the inter-drum time Ta.

The CPU 211 determines whether or not the sheet P has been detected by the sheet sensor 19 (Step S103). In a case where the sheet P has not been detected (NO in Step S103), the CPU 211 sets the predetermined time periods (correction amounts) Tb1, Tb2, and Tb3 to zero, respectively (Step S104). The light scanning devices 3*b*, 3*c*, and 3*d* start writing succeeding images at intervals of the inter-drum time Ta. In contrast, in a case where the sheet P has been detected (YES in Step S103), the CPU 211 determines from the media information on the sheet P stored in the RAM 121 whether or not the basis weight of the sheet P is the predetermined amount or more (Step S105). According to the embodiment, the predetermined amount is set to 129 $g/m^2$ but may be set to another value.

In a case where the basis weight of the sheet P is the predetermined amount or more (YES in Step S105), the CPU 211 sets the predetermined time periods Tb1, Tb2, and Tb3 according to the media information (Step S106). The light scanning devices 3*b*, 3*c*, and 3*d* start writing images after the time periods including the inter-drum time Ta and the predetermined time periods Tb1, Tb2, and Tb3, respectively. In contrast, in a case where the basis weight of the sheet P is less than the predetermined amount (NO in Step S105), the CPU 211 sets the predetermined time periods (correction amounts) Tb1, Tb2, and Tb3 to values of zero, respectively (Step S107). The light scanning devices 3*b*, 3*c*, and 3*d* start writing images at intervals of the inter-drum time Ta.

The CPU 211 detects the home position seal 33 arranged on the intermediate transfer belt 7 with the sensor 34 to detect the one round time (i.e., predetermined time period Tm) of the intermediate transfer belt 7. The CPU 211 determines whether or not the sheet-to-sheet interval is the predetermined time period Tm or more (Step S108). In a case where the sheet-to-sheet interval is the predetermined time period Tm or more (YES in Step S108), the process returns to Step S104 and the CPU 211 sets the predetermined time periods (correction amounts) Tb1, Tb2, and Tb3 to zero, respectively. The light scanning devices 3*b*, 3*c*, and 3*d* start writing succeeding images at intervals of the inter-drum time Ta.

In contrast, in a case where the sheet-to-sheet interval is less than the predetermined time period Tm (NO in Step S108), the CPU 211 determines whether or not the job has been completed (Step S109). In a case where the job has not been completed (NO in Step S109), the process returns to Step S105. In a case where the predetermined time periods (correction amounts) Tb1, Tb2, and Tb3 are to be changed according to the basis weight and the media information on the sheet P, the predetermined time periods (correction amounts) Tb1, Tb2, and Tb3 are changed (Steps S106 and S107). The light scanning devices 3*b*, 3*c*, and 3*d* start writing images after the time periods including the inter-drum time Ta and the changed predetermined time periods Tb1, Tb2, and Tb3, respectively. In a case where the job has been completed (YES in Step S109), the CPU 211 finishes the operation for correcting the exposure start timing.

According to the embodiment, in the image forming apparatus 100 in which the intermediate transfer belt 7 and the secondary transfer belt 9 have their own drive sources to have a surface speed difference therebetween, image color misregistration in continuous image formation can be reduced irrespective of a sheet type and conditions for passing sheets.

(Modified Example of Correction of Exposure Start Timing)

Figure 17:
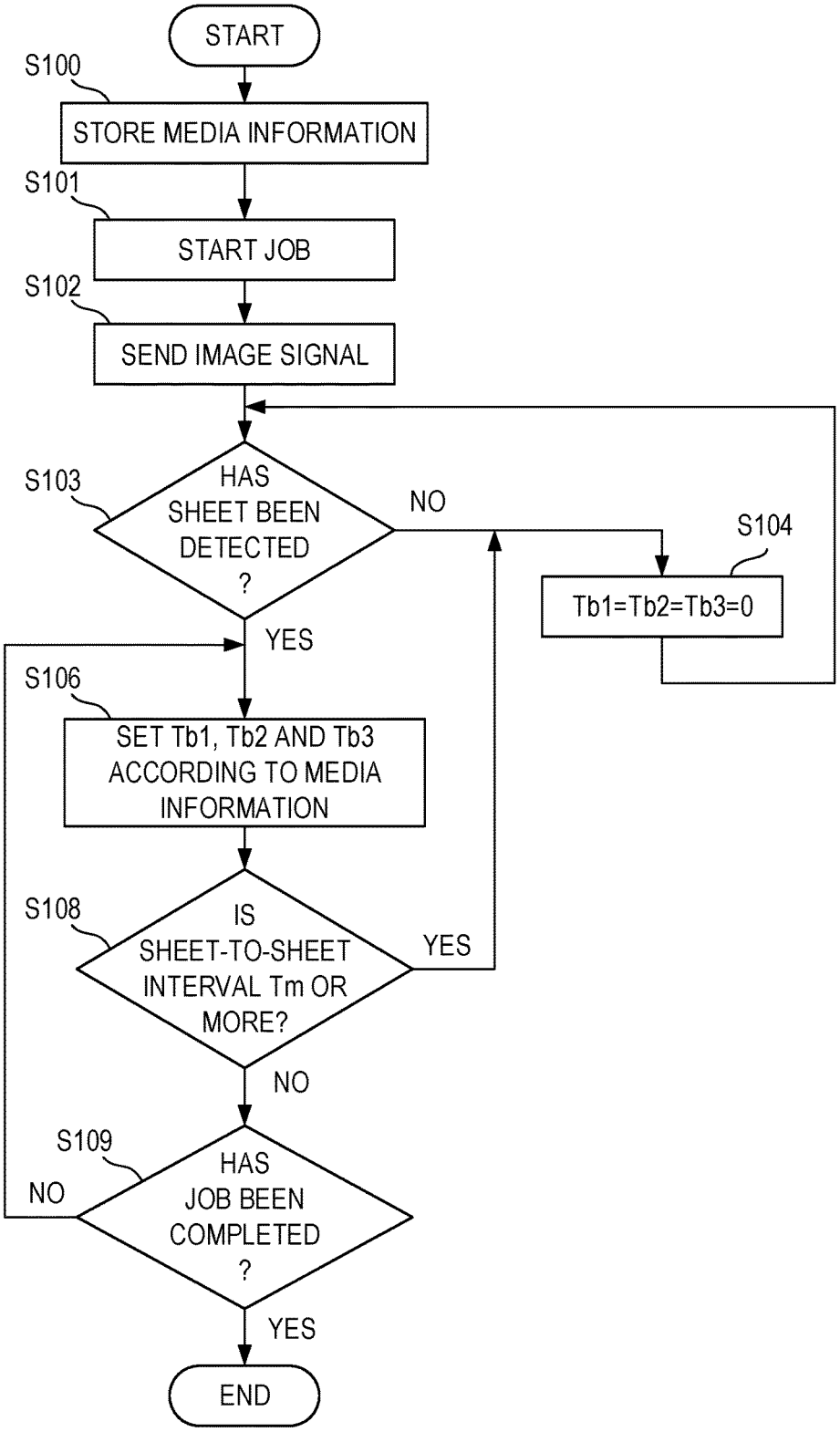
FIG. 17 is a flow chart for illustrating a modified example of the operation for correcting the exposure start timing using the control system.

FIG. 17 is used to describe a modified example of the correction of exposure start timing. FIG. 17 is a flow chart for illustrating the modified example of the operation for correcting the exposure start timing using the control system 200. The flow chart of FIG. 17 is the same as that of FIG. 16 except that Steps S105 and S107 in the flow chart of FIG. 16 are deleted. Steps S100 to S104 are the same as Steps S100 to S104 in FIG. 16 and hence their description is omitted. In a case where the sheet P has been detected (YES in Step S103), the CPU 211 sets the predetermined time periods Tb1, Tb2, and Tb3 according to the media information based on the lookup tables shown in FIG. 12A, FIG. 12B, and FIG. 12C stored in the RAM 121 (Step S106). The light scanning devices 3*b*, 3*c*, and 3*d* start writing images after the time periods including the inter-drum time Ta and the predetermined time periods Tb1, Tb2, and Tb3, respectively. Subsequent Steps S108 and S109 are the same as Steps S108 and S109 in FIG. 16 and hence their description is omitted. Also in the modified example illustrated in FIG. 17, the same effect as in the embodiment can be achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-151730, filed Jul. 31, 2015, which is hereby incorporated by reference herein in its entirety.

What is claimed is:

1. An image forming apparatus comprising:

an image forming unit comprising a first photosensitive member and a second photosensitive member, the image forming unit being configured to expose the first photosensitive member and the second photosensitive member to light based on image data, and to develop electrostatic latent images formed on the first photosensitive member and the second photosensitive member by exposure to the light with toners of different colors;

an endless transfer belt stretched around a plurality of rollers and driven to rotate, wherein a toner image on the first photosensitive member and a toner image on the second photosensitive member are transferred onto the endless transfer belt;

a transfer unit configured to transfer the toner images on the endless transfer belt onto a recording medium entering a transfer nip formed between the transfer unit and the endless transfer belt, wherein in a direction of rotation of the endless transfer belt, a second transfer portion at which the toner image on the second photosensitive member is transferred onto the endless transfer belt is arranged between a first transfer portion at which the toner image on the first photosensitive member is transferred onto the endless transfer belt and the transfer unit;

a holding unit configured to hold recording media;

a conveyance unit configured to convey the recording medium held by the holding unit to the transfer nip;

a storage unit configured to store delay data indicating an amount of delay of an exposure start timing of the second photosensitive member with respect to an exposure start timing of the first photosensitive member for forming electrostatic latent images corresponding to one recording medium, wherein the delay data includes: first delay data indicating the amount of delay of the exposure start timing of the second photosensitive member; and second delay data indicating the amount of delay of the exposure start timing of the second photosensitive member, and the amount of delay based on the second delay data is larger than the amount of delay based on the first delay data; and a control unit configured to delay the exposure start timing of the second photosensitive member with respect to the exposure start timing of the first photosensitive member on image formation corresponding to one recording medium, wherein in a state in which an image forming job for forming the images on a plurality of the recording media is inputted, the control unit controls the exposure start timing of the second photosensitive member based on the first delay data until a first recording medium included in the plurality of the recording media enters the transfer nip and controls the exposure start timing of the second photosensitive member based on the second delay data after the first recording medium enters the transfer nip.

2. An image forming apparatus according to claim 1, wherein in a state in which the plurality of the recording media on which the images are formed based on the image forming job are identical in size and an interval between an N-th recording medium and an N+1th recording medium is increased more than a size of at least one recording medium after start of the image formation based on the image forming job, on control of the exposure start timing for image formation on the N+1th and subsequent recording media, the control unit controls the exposure start timing of the second photosensitive member based on the first delay data until the N+1th recording medium enters the transfer nip and controls the exposure start timing of the second photosensitive member based on the second delay data after the N+1th recording medium enters the transfer nip.

3. An image forming apparatus according to claim 2, further comprising:

a first light source configured to emit a first light beam;

a first rotary polygon mirror configured to deflect the first light beam so that the first photosensitive member is exposed to the first light beam;

a second light source configured to emit a second light beam; and a second rotary polygon mirror configured to deflect the second light beam so that the second photosensitive member is exposed to the second light beam, wherein in a state in which the control unit changes over the delay data for use in controlling the exposure start timing of the second photosensitive member from the first delay data to the second delay data, the control unit controls, based on the second delay data, relative rotation phases of the first rotary polygon mirror and the second rotary polygon mirror and emission timings of the first light beam emitted by the first light source and the second light beam emitted by the second light source.

4. An image forming apparatus according to claim 1, wherein the transfer unit comprises a rotary member, wherein a drive source configured to rotate the endless transfer belt is provided independent of a drive source configured to rotate the transfer unit, and wherein a surface speed of the endless transfer belt is set to be different from a surface speed of the transfer unit.

5. An image forming apparatus according to claim 4, wherein the surface speed of the transfer unit is set to be lower than the surface speed of the endless transfer belt.

6. An image forming apparatus according to claim 1, further comprising:

a first light source configured to emit a first light beam;

a first rotary polygon mirror configured to deflect the first light beam so that the first photosensitive member is exposed to the first light beam;

a second light source configured to emit a second light beam; and a second rotary polygon mirror configured to deflect the second light beam so that the second photosensitive member is exposed to the second light beam, wherein in a state in which the control unit changes over the delay data for use in controlling the exposure start timing of the second photosensitive member from the first delay data to the second delay data, the control unit controls, based on the second delay data, relative rotation phases of the first rotary polygon mirror and the second rotary polygon mirror and emission timings of the first light beam emitted by the first light source and the second light beam emitted by the second light source.

7. An image forming apparatus according to claim 1, wherein the endless transfer belt comprises an elastic layer.

8. An image forming apparatus comprising:

an image forming unit comprising a first photosensitive member and a second photosensitive member, the image forming unit being configured to expose the first photosensitive member and the second photosensitive member to light based on image data, and to develop electrostatic latent images formed on the first photosensitive member and the second photosensitive member by exposure to the light with toners of different colors;

an endless transfer belt stretched around a plurality of rollers and driven to rotate, wherein a toner image on the first photosensitive member and a toner image on the second photosensitive member are transferred onto the endless transfer belt;

a transfer unit configured to transfer the toner images on the endless transfer belt onto a recording medium entering a transfer nip formed between the transfer unit and the endless transfer belt, wherein in a direction of rotation of the endless transfer belt, a second transfer portion at which the toner image on the second photosensitive member is transferred onto the endless transfer belt is arranged between a first transfer portion at which the toner image on the first photosensitive member is transferred onto the endless transfer belt and the transfer unit;

a holding unit configured to hold recording media;

a conveyance unit configured to convey the recording medium held by the holding unit to the transfer nip;

a storage unit configured to store delay data indicating an amount of delay of an exposure start timing of the second photosensitive member with respect to an exposure start timing of the first photosensitive member for forming electrostatic latent images corresponding to one recording medium, wherein the delay data stored in the storage unit includes: first delay data and second delay data set with respect to a first type recording medium;

and third delay data set with respect to a second type recording medium different in type from the first type recording medium and having a smaller basis weight than the first type recording medium, wherein the first delay data indicates an amount of delay of the exposure start timing of the second photosensitive member, the second delay data indicates an amount of delay of the exposure start timing of the second photosensitive member, and the amount of delay based on the second delay data is larger than the amount of delay based on the first delay data, and wherein the third delay data indicates an amount of delay of the exposure start timing of the second photosensitive member with respect to the exposure start timing of the first photosensitive member; and a control unit configured to delay the exposure start timing of the second photosensitive member with respect to the exposure start timing of the first photosensitive member on image formation corresponding to one recording medium, wherein in a state in which an image forming job for forming images on a plurality of first type recording media is inputted, the control unit controls the exposure start timing of the second photosensitive member based on the first delay data until a first recording medium included in the plurality of the first type recording media enters the transfer nip and controls the exposure start timing of the second photosensitive member based on the second delay data after the first recording medium enters the transfer nip, and wherein in a state in which an image forming job for forming images on a plurality of second type recording media, the control unit controls the exposure start timing of the second photosensitive member based on the third delay data before and after a first recording medium in the plurality of the second type recording media enters the transfer nip.

9. An image forming apparatus according to claim 8, wherein in a state in which the plurality of the recording media on which the images are formed based on the image forming job are identical in size and an interval between an N-th recording medium and an N+1th recording medium is increased more than a size of at least one recording medium after start of the image formation based on the image forming job, on control of the exposure start timing for image formation on the N+1th and subsequent recording media, the control unit controls the exposure start timing of the second photosensitive member based on the first delay data until the N+1th recording medium enters the transfer nip and controls the exposure start timing of the second photosensitive member based on the second delay data after the N+1th recording medium enters the transfer nip.

10. An image forming apparatus according to claim 9, further comprising:

a first light source configured to emit a first light beam;

a first rotary polygon mirror configured to deflect the first light beam so that the first photosensitive member is exposed to the first light beam;

a second light source configured to emit a second light beam; and a second rotary polygon mirror configured to deflect the second light beam so that the second photosensitive member is exposed to the second light beam, wherein in a state in which the control unit changes over the delay data for use in controlling the exposure start timing of the second photosensitive member from the first delay data to the second delay data, the control unit controls, based on the second delay data, relative rotation phases of the first rotary polygon mirror and the second rotary polygon mirror and emission timings of the first light beam emitted by the first light source and the second light beam emitted by the second light source.

11. An image forming apparatus according to claim 8, wherein the transfer unit comprises a rotary member, wherein a drive source configured to rotate the endless transfer belt is provided independent of a drive source configured to rotate the transfer unit, and wherein a surface speed of the endless transfer belt is set to be different from a surface speed of the transfer unit.

12. An image forming apparatus according to claim 11, wherein the surface speed of the transfer unit is set to be lower than the surface speed of the endless transfer belt.

13. An image forming apparatus according to claim 8, wherein the endless transfer belt comprises an elastic layer.

* * * * *